US005476155A

United States Patent [19]

Nakatani et al.

[11] Patent Number: 5,476,155

[45] Date of Patent: Dec. 19, 1995

[54] STAIRWAY LIFT

[75] Inventors: Masato Nakatani; Hiroshi Kawai; Chikayuki Higashide; Yoshihiro Kitamura; Megumi Nishino, all of Ishikawa; Yoshimasa Yamamoto, Tokyo; Hideo Kikuchi, Tokyo; Yoshio Shimada, Tokyo; Hidenori Suzuki, Tokyo; Hiroshi Aoki, Tokyo; Takahiro Shimizu, Tokyo, all of Japan

[73] Assignee: Daido Kogyo Co., Ltd., Ishikawaken, Japan

[21] Appl. No.: 242,003

[22] Filed: May 12, 1994

[51] Int. Cl.[6] ..... B66B 9/08

[52] U.S. Cl. ..... 187/202; 187/201; 187/246; 187/245

[58] Field of Search ..... 187/200, 201, 187/202, 245, 246, 269, 270, 373

[56] References Cited

U.S. PATENT DOCUMENTS

| | | | |
|---|---|---|---|
| 1,405,301 | 1/1922 | DeVol | 187/269 X |
| 2,507,887 | 5/1950 | Cheney | 187/270 X |
| 2,719,607 | 10/1955 | Scott | 187/202 |
| 4,345,669 | 8/1982 | Noall | 187/201 |
| 4,564,086 | 1/1986 | Kingston | 187/201 |
| 4,913,264 | 4/1990 | Voves et al. | 187/201 |
| 5,050,708 | 9/1991 | Wood | 187/201 |

*Primary Examiner*—William E. Terrell
*Assistant Examiner*—Dean A. Reichard
*Attorney, Agent, or Firm*—Wenderoth, Lind & Ponack

[57] ABSTRACT

A stairway lift is provided on the treads of a stairway along a sidewall. A guide of the lift is provided on the treads along the sidewall so that a space is formed between the sidewall and the guide. The guide has a first side that faces the sidewall, a first rail provided on the first side, a chain rack on the first side that extends along the sidewall and a second side that faces away from the sidewall. A mobile body is supported by the first rail in the space formed between the sidewall and the guide. The mobile body has a drive sprocket engageable with the chain rack and an electric motor coupled with the drive sprocket for rotatively driving the drive sprocket. A carrier is provided for carrying a person or object to be moved along the stairway. A coupling arrangement couples the mobile body and the carrier so that the carrier is removably supported by the mobile body on the second side of the guide and guided for travel by the guide. The carrier can thus ascend and descend the stairway together with the mobile body.

19 Claims, 23 Drawing Sheets

FIG.6(a)
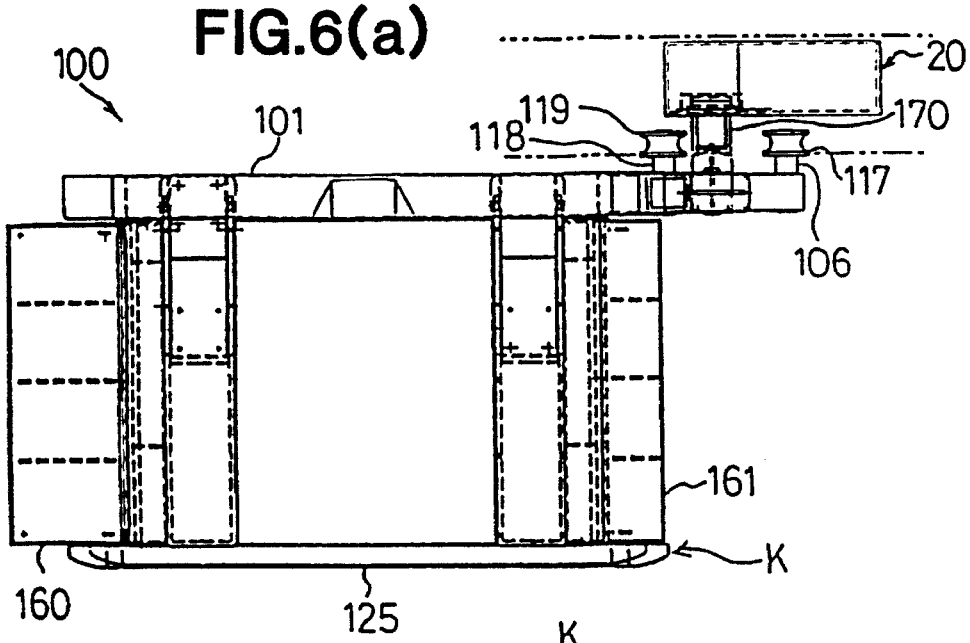
FIG.6(b)
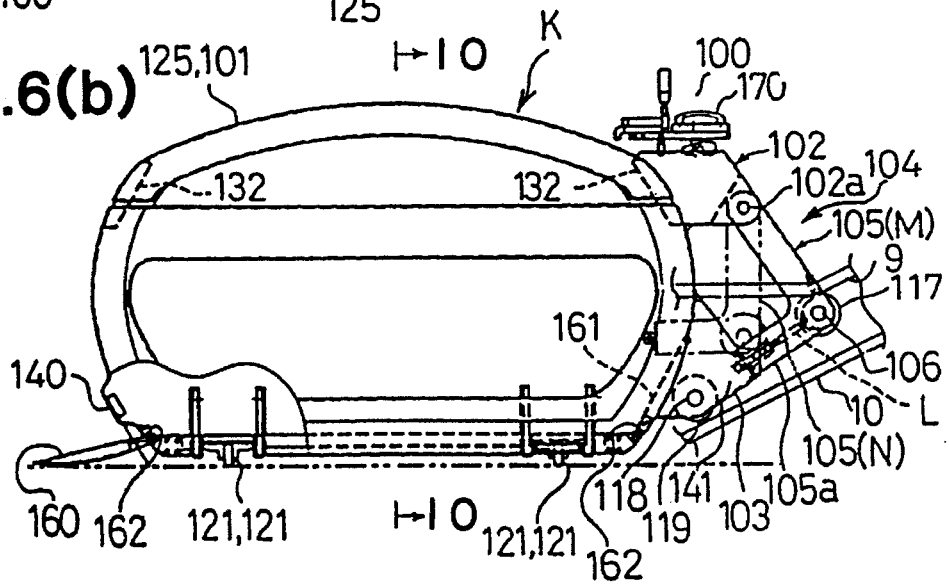
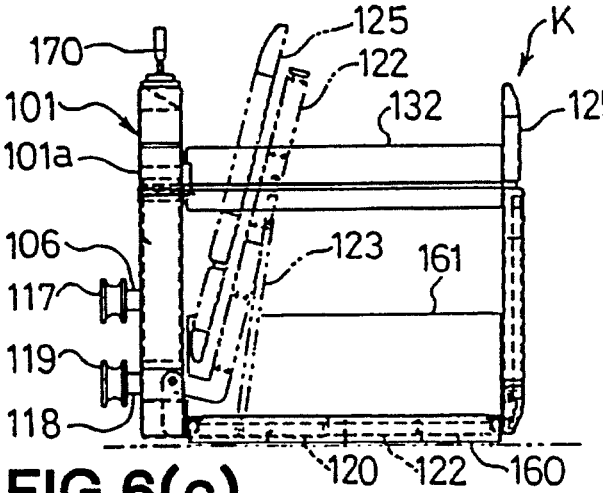
FIG.6(c)
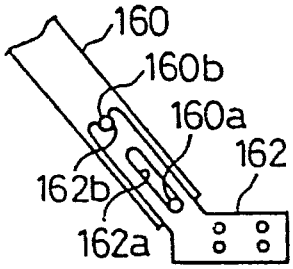
FIG.6(d)

FIG.15(a)
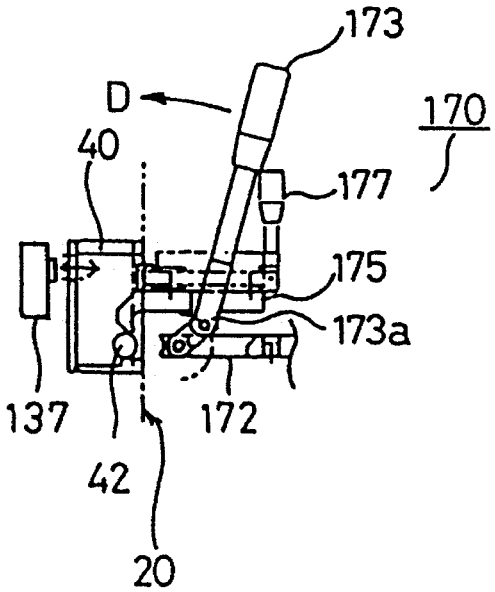
FIG.15(b)
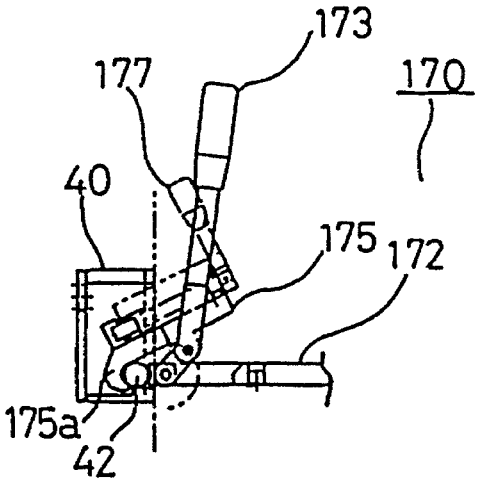
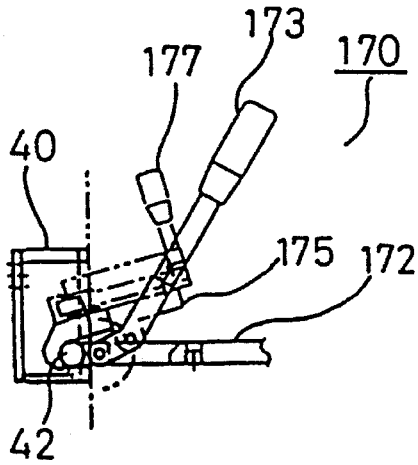
FIG.15(c)
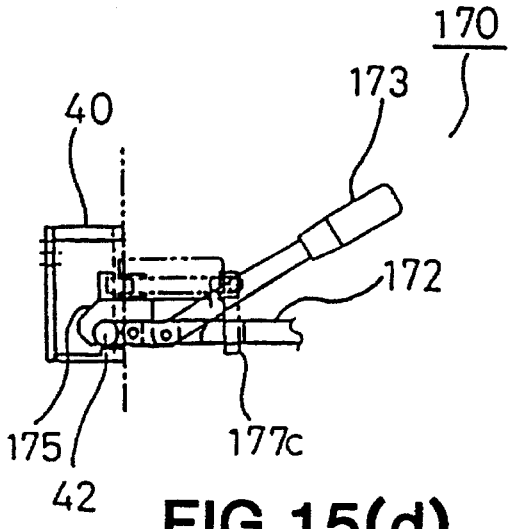
FIG.15(d)

FIG.21(a)
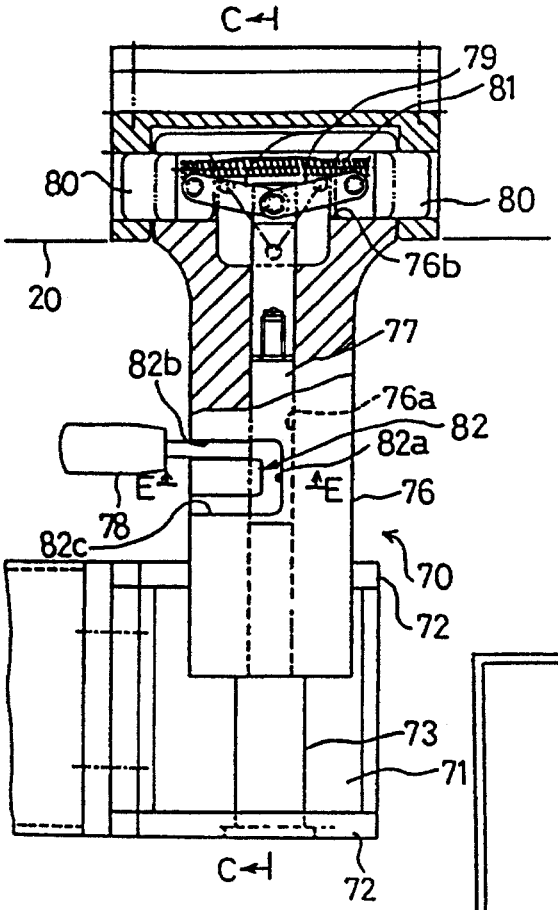
FIG.21(b)
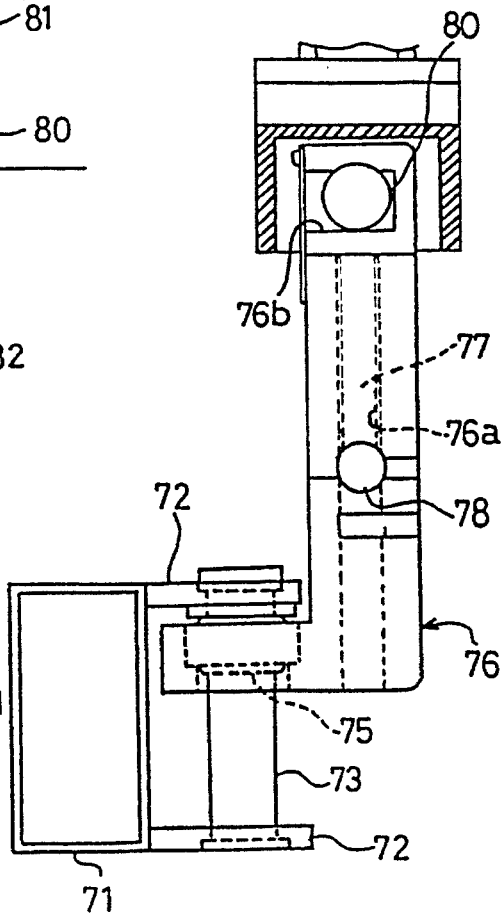
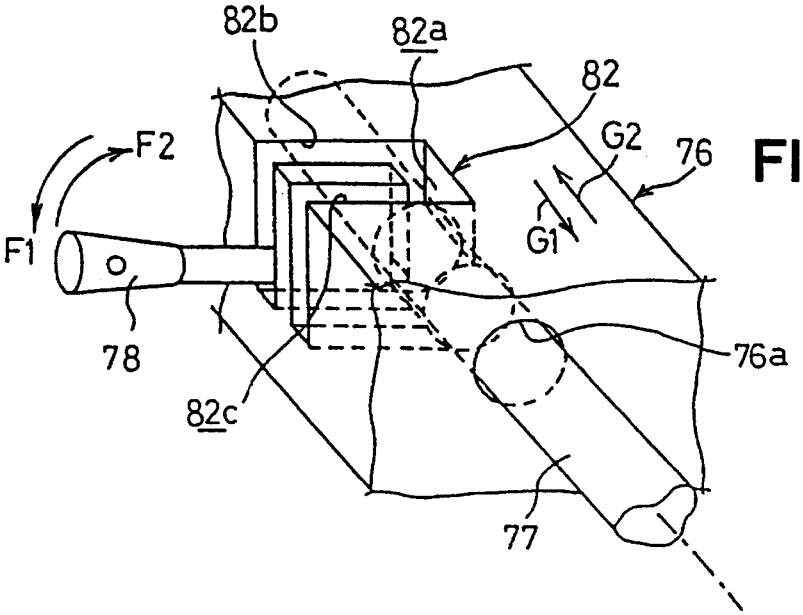
FIG.21(c)

STAIRWAY LIFT

BACKGROUND OF THE INVENTION

1. Field of the Invention

The present invention is related to a stairway lift to be installed along a stairway to carry a user or luggage upward and downward, and more particularly, to a stairway lift to be preferably installed in a public facility such as a station.

2. Description of the Prior Art

Several measures have been taken recently to enable physically handicapped people to use public facilities more, and in particular, to go upstairs and downstairs when in a wheelchair in a station or any other public facility. It may be possible to install a special elevator for physically handicapped people in a facility which a lot of them visit. However, the elevator or any other hearts of a similar kind is expensive and requires much space and time for installation. Inexpensive stairway lifts have, therefore, been drawing attention because they need less space and time for installation in a public facility, especially in a facility which people do not frequent. There are some types already proposed.

FIG. 22 shows an example as published in the Tokkaisho 60-87184, and the disclosed stairway lift 300 is equipped with guide rails 303, 303 installed on the side wall 302 along a stairway 301. There is also provided a rack 305 between the guide rails 303, 303. There is movably supported a carrier 306, which is approximately L-shaped in section, on the guide rails 303, 303, the carrier 306 being equipped with a motor 307 and a drive sprocket 309 to be driven by the motor 307. The drive sprocket 309 is engaged with the rack 306 on the side wall, and the motor 307 driven sprocket 309 enables the carrier 306 to go up and down.

Although the stall, way lift 300 may be installed more readily than an elevator, there is still heft something to be desired. Partly because it may not be available if the side wall 302 of the stairway is not strong enough, and partly because the carrier 306 mounted onto the guide rails 303, 303 projects so much toward the stairway that it interferes with traffic on the stairway.

FIG. 23 through FIG. 26 show another example as published in the Tokkaisho 58-63676. The disclosed stairway lift 200 is equipped with guide rails 203, 205 installed linearly along the side wall 202 of a stairway 201, the guide rails 203, 205 having elongated holes 203*a*, 205*a* (as illustrated in FIG. 24). There is mounted a rack 210 under the guide rail 203 (FIG. 24).

A mobile body 209 is supported by these guide rails 203, 205. The mobile body 209 has a pair of arms 207, 207 (see FIG. 25) extending toward the guide rails 203, 205, and guide rollers 206, 206 rotatively supported by the front ends of the arms 207, 207. Because the guide rollers 206, 206 are furnished in the guide rails 203, 205, the mobile body 209 is then movably supported by the guide rails 203, 205 (see FIG. 26). The opening of each of the long holes 203*a*, 205*a* of the guide rails 203, 205 is smaller by design than the vertical size (outer diameter) of each of the guide rollers 206, 206 to prevent the rollers from coming out through the holes. The mobile body 209 is equipped with a drive sprocket 211 and an electric motor 212, the rive sprocket 211 being engaged with the rack 210 under the guide rail 203 and driven by the motor 212. Moreover, these guide rollers 206, 206 are provided with a plurality of vertically operative guide rollers 206*a* and a plurality of laterally operative guide rollers 206*b* respectively as illustrated in FIG. 24. The mobile body 209 is thus constructed so that it travels in parallel along the guide rails 203, 205, always keeping the same posture toward the guide rails 203, 205. There is a carrier 215 secured to the mobile body 209 with a bolt 213 and there are mounted casters 216, 216, 216, 216 onto the bottom of the carrier 215.

Now that the stairway lift 200 is constructed as described above, the carrier 215, when not used, may be removed from the mobile body 209 by releasing the bolt 213 and transported manually using the casters and stored in a place which does not cause any interference with traffic. When carrying a person on a wheelchair from downstairs to upstairs, using the stairway lift 200, the mobile body 209 is first operated electrically to move to the guide rails 203, 205 to the lowest limit. The carrier 215 is then transported manually from where it is stored to the mobile body 209. The carrier 215 is mounted onto the mobile body 209 with the bolt 213. After putting the wheelchaired person on the carrier, the electric motor 212 of the mobile body 209 is started to drive the sprocket 211, and the mobile body 209 supporting the drive sprocket 211 starts ascending the stairway 201 along the guide rails 203, 205 as the rack 210 engaged with the sprocket 211 is secured to the guide rail 203 side. The driving electric motor 212 is stopped when the carrier 215 gets upstairs, and the mobile body 209 and the carrier 215 are stopped to get the wheelchaired person off the carrier 215. As the mobile body 209 is so supported as to travel in parallel by way of the guide rollers 206, 206 and the carrier 215 is secured to the mobile body 209, the carrier 215 is supposed to travel, keeping the same posture toward the guide rails 203, 205. As mentioned above, the stairway lift 200 allows the carrier 215 to be removed and stored in a place which does not hinder any traffic when not used, while the mobile body 209 remains mounted on the guide rails 203, 205 and projecting toward the stairway to an extent that it interferes with traffic. In addition, it is necessary to transport the carrier 215 to the stairway from where it is stored for the purpose of using the stairway lift 200. This may cause the carrier 215 to interfere with traffic. Furthermore, mounting the carrier 215 onto the mobile body 209 with the bolt 213 is not so easy even with a tool, and it is then necessary to move the carrier 215 to match the bolt 213 with the bolt hole (not shown) of the mobile body 209. If the bolt 213 comes off while the carrier 215 is ascending or descending the stairway 201, the carrier 215 will fall down. There are some other difficulties to overcome if the stairway lift 200 is installed along a stairway having a landing or a platform because it is troublesome to linearly form the guide rails 203, 205. Unless the rails are linearly formed, the carrier will fail to travel and keep the same horizontal posture toward the guide rails 203, 205. In addition, it is necessary to extend the guide rails 203, 205 to the floor downstairs and bring the mobile body 209 near the carrier 215 to mount the latter onto the former. In such an instance, however, the guide rails 203, 205 may protrude into the traffic passage and interfere with traffic.

SUMMARY OF THE INVENTION

It is an object of the present invention, accordingly, to provide a stairway lift occupying minimum space in a stairway and being able to prevent a mobile body which to transports a carrier from interfering with traffic. It is another object of the present invention to provide a stairway lift in which the carrier and the mobile body can be readily coupled and disconnected and for which an adequate measure can be taken to prevent the carrier from coming off the mobile body.

It is another object of the prevent invention to provide a stairway lift able to have the carrier always travel while keeping a horizontal posture, regardless of the construction of the stairway where the stairway lift is installed.

It is further another object of the present invention to provide a stairway lift that minimally interferes with traffic when the carrier is manually moved, and needing a narrower space For the installation of the carrier.

It is another object of the present invention to provide a stairway lift equipped with a guide means which does not protrude and hinder any traffic.

A stairway lift according to the present invention as proposed, in view of the above, is installed on the treads of a stairway along the sidewall thereof, producing a space between the sidewall and itself. The stairway lift is characterized in that it is equipped with a guide means having a first rail formed opposite to the side wall, a mobile body supported by the first rail and electrically traveling in the space between the guide means and the sidewall and a carrier removably supported by the mobile body by way of a coupling means provided therein, and is designed to ascend and descend the stairway together with the mobile body. The carrier, led by the guide means, travels on the other side of the guide means from the mobile body, opposite to the sidewall.

As thus composed, the mobile body supported by the first rail is electrically operated when the mobile body moves in the space between the guide means and the sidewall. As the carrier is supported by the mobile body, the carrier goes upstairs and downstairs together with the mobile body. Note that the carrier travels on the guide means on the other side of the guide means from the sidewall.

In the event that the stairway lift according to the present invention is not used, the carrier may be disconnected from the mobile body and stored in a specified place. The guide means remains, accordingly, installed along the sidewall of the stairway and the mobile body remains arranged between the guide means and the sidewall.

BRIEF DESCRIPTION OF THE DRAWINGS

FIG. 6 (*a*) is a plan view of a basket, FIG. 6 (*b*) a front view thereof, FIG. 6 (*c*) a left side view and FIG. 6 (*d*) is a view showing the construction of a gangway board support.

FIG. 15 (*a*) shows a raised clamp lever, FIG. 15 (*b*) shows the clamp lever further raised to engage with the shaft member at the front end, FIG. 15 (*c*) is a view showing the clamp lever is restored for clamping, and FIG. 15 (*d*) shows when clamping is over.

FIG. 21 (*a*) is a plan view showing the construction of an attachment, FIG. 21 (*b*) is a left side view thereof, and FIG. 21 (*c*) is a slant view showing guide grooves.

DESCRIPTION OF THE PREFERRED EMBODIMENT

Embodiments of the present invention will be described with reference to the attached drawings.

The first embodiment of the present invention will be first described, referring to FIGS. 1 through 15.

Figure 1:
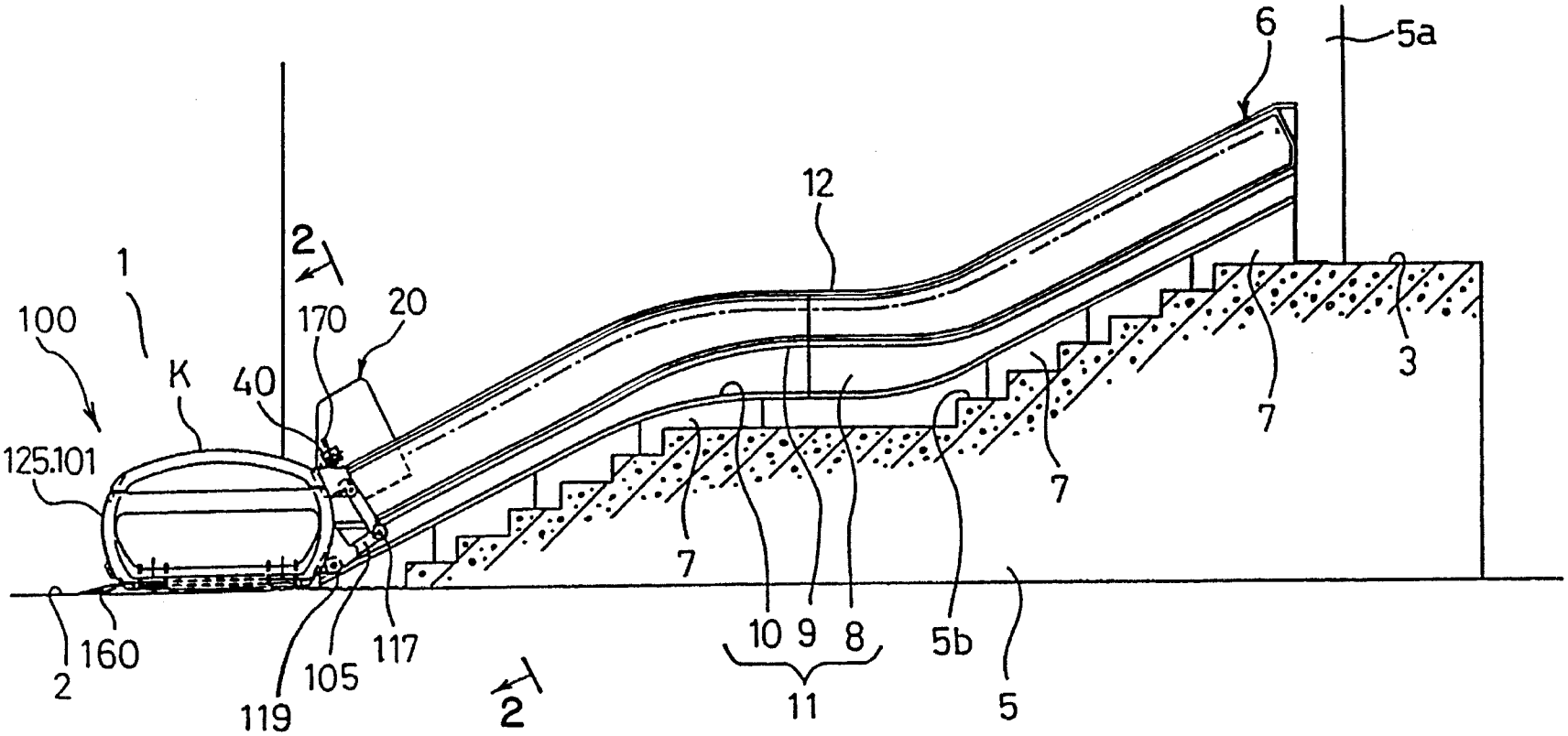
FIG. 1 is a front elevation showing a stairway lift according to the present invention.

A stairway lift 1 is, as illustrated in FIG. 1, equipped with a guide means 6 being formed along a stairway 5 connecting a downstairs 2 with an upstairs 3, the guide means 6 supporting movably a traction means (mobile body) 20 and a basket (carrier) 100. The traction means 20 and the basket 100 are coupled with each other, and the basket 100 is so designed as to ascend and descend the stairway 5 as the traction means is electrically operated to move along the guide means 6.

Figure 2:
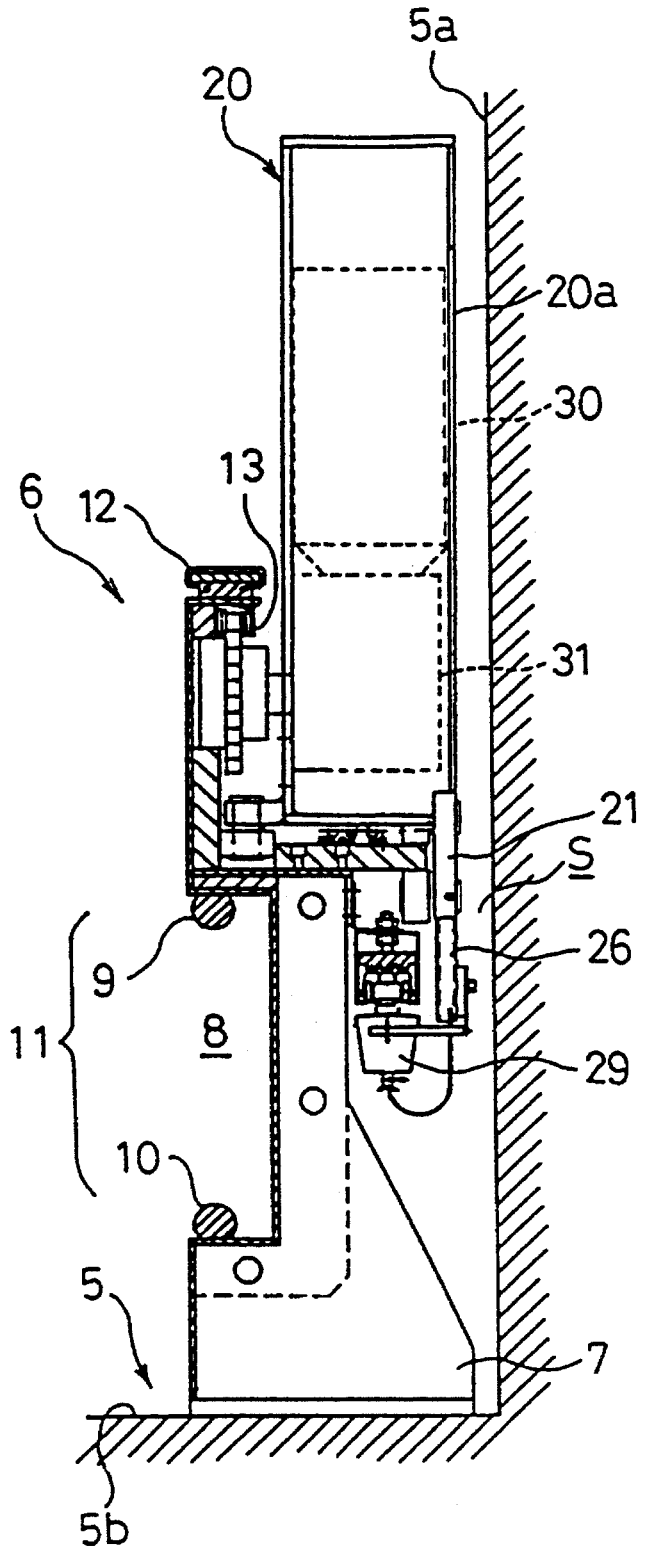
FIG. 2 is a sectional view in along line 2—2 of FIG. 1.
Figure 3:
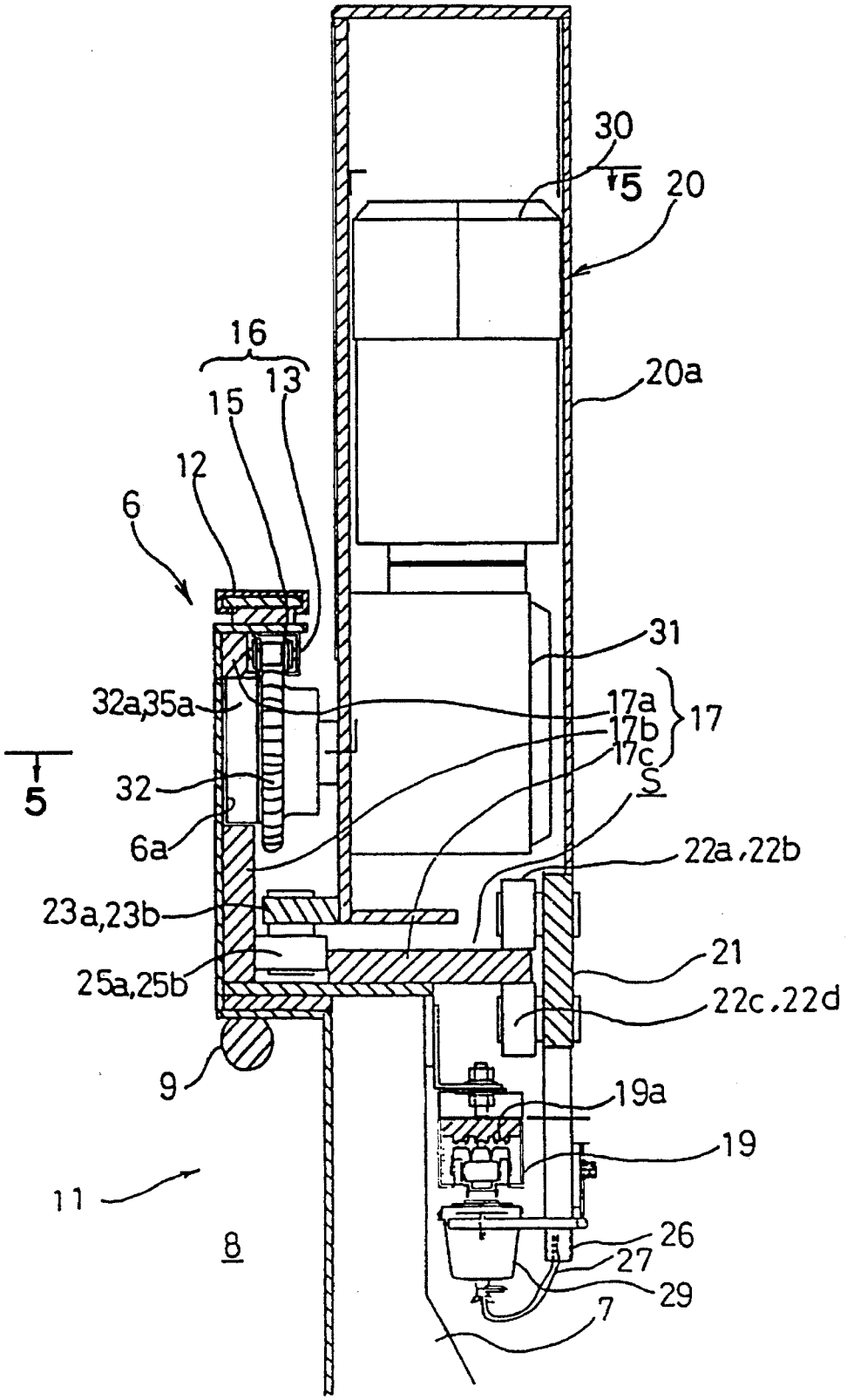
FIG. 3 is a detailed vertical sectional view of a traction means and a guide means to support the traction means.

Referring to FIGS. 1 to 3, the guide means 6 will be described first in terms of the construction.

As shown in FIG. 2, the guide means 6 is secured by the leg 7 to the stairway tread 5*b* using a drill anchor (not shown). The guide means 6 is installed, and installed along the sidewall 5*a* and is spaced therefrom to produce a space S between the guide means 6 and the sidewall 5*a*.

The guide means 6 is provided facing the stairway 5 (left side in FIG. 2. To be called as front side, and the side facing the sidewall 5*a* is called as rear side) with a basket guide rail 11 at a specified height covering the upstairs 3 to the downstairs 2, the rail 11 having a concavity (recess) 8. A top roller guide (guide rail) 9, almost circular in section, is furnished at the top of the concavity 8 and a bottom roller guide (guide rail) 10, also almost circular in section, at the bottom thereof. The roller guides 9, 10 are designed to support the basket 100 by means of rotatable guide rollers 117, 119 (later detailed). The interval (or the vertical distance) between the top roller guide 9 and the bottom roller guide 10 is, as shown in FIG. 1, not constant but varied from the downstairs 2 to the upstairs 3 of the stairway 5. This is because it is intended to enable the basket 100 being supported by the guide rollers 117, 119 to keep its horizontal posture while traveling.

The guide means 6 is 800 mm to 900 mm high, and comprises a handrail 12 provided at its top end and extending between the upstairs 3 and the downstairs 2 for those who ascend or descend the stairway 5.

As shown in detail in FIG. 3, there is provided a traction means guide rail 17 (first rail) extending from the upstairs 3 to the downstairs 2, the guide rail 17 comprising rail members 17*a*, 17*b* arranged at a specified interval to form a groove 6*a* and another rail member 17*c* projecting into the space S formed between the guide means 6 and the sidewall 5*a*.

Further, there is a plate member 13 suspended from the handrail 12 bottom, the plate member 13 producing a concavity with the rail member 17*a*, opening below. There is provided a roller chain 15 in the concavity, the chain 15 being designed to allow for a certain play and maintained so as not to fall. A chain rack 16 is thus comprised of the chain 15, plate member 13 and rail member 17*a*.

There is provided a power supply trolley duct 19 under the rail member 17*c*, and there is provided in the duct 19 a power supply cable 19*a* to be supplied with voltage from a power supply (not shown). Not only the handrail 12, chain rack 16, and traction means guide rail 17 (rail members 17*a*, 17*b*, 17*c*), but also the power supply cable 19*a* is provided to extend from the upstairs 3 to the downstairs 2 of the stairway 5.

Figure 4:
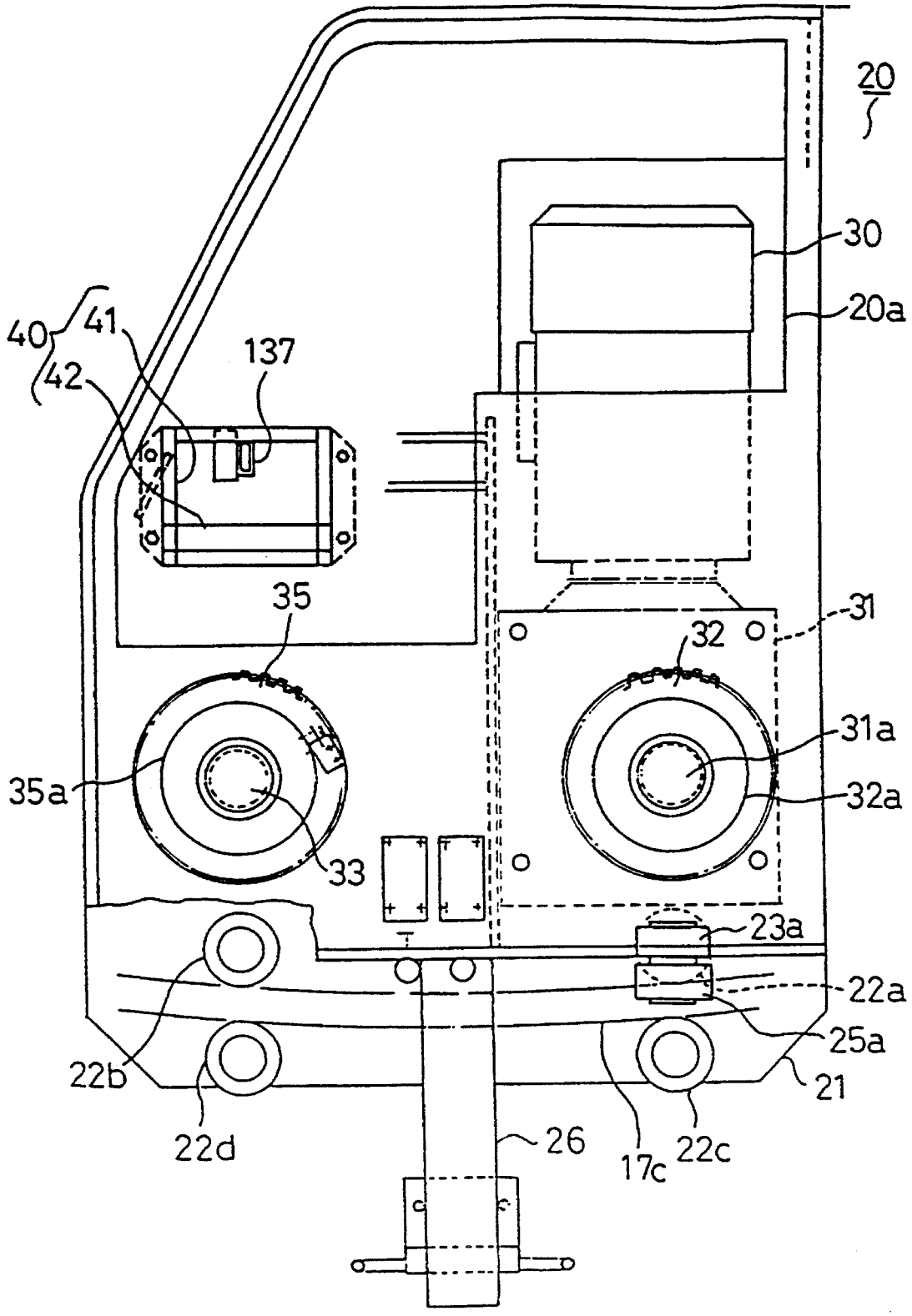
FIG. 4 is a detailed front view showing the traction means.
Figure 5:
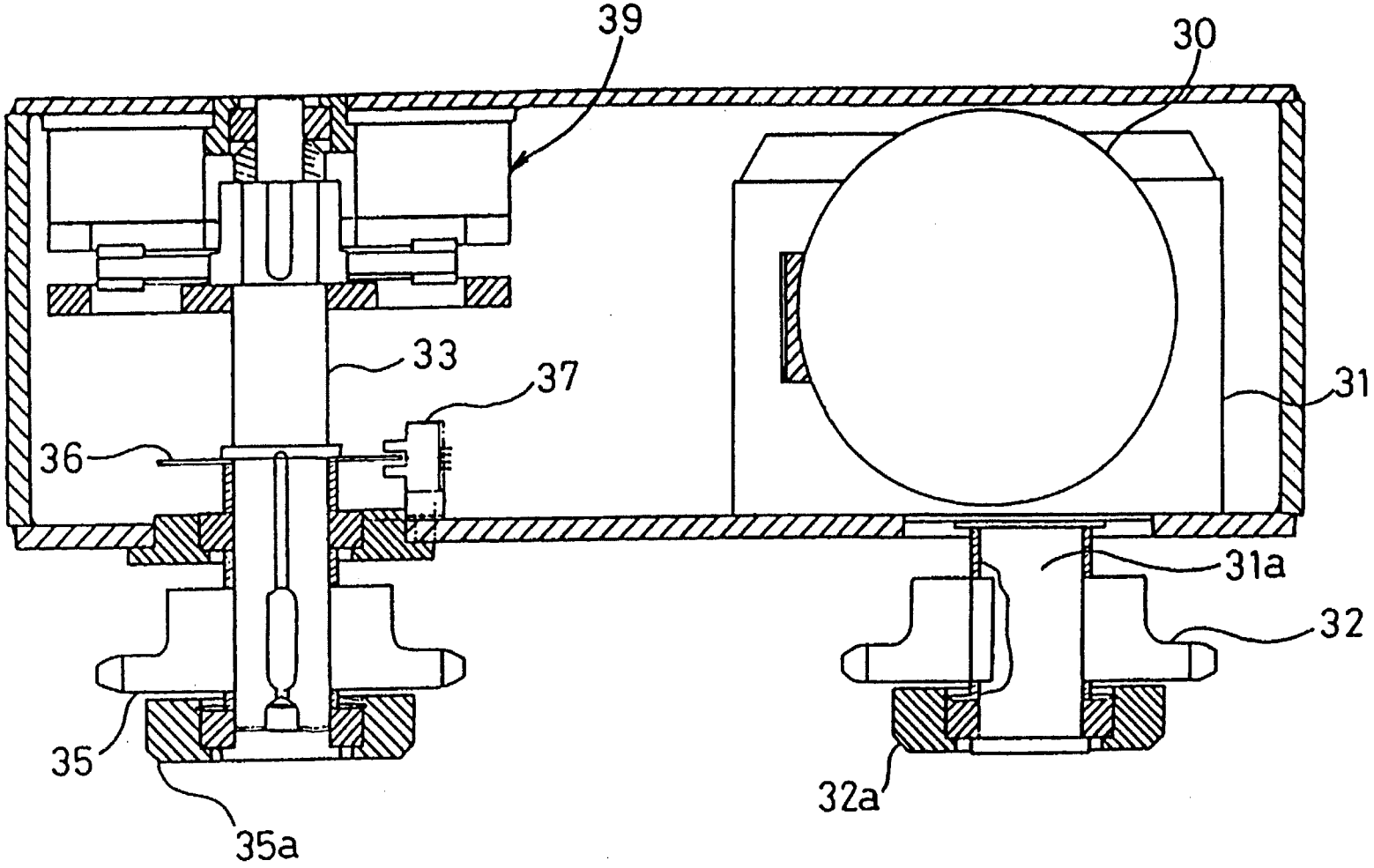
FIG. 5 is a sectional view in along lien 5—5 of FIG. 3.

A description of the traction means (mobile body) 20 for travelling along the guide rail 6 will follow with reference to FIG. 3 to FIG. 5.

The traction means 20 comprises, as shown in FIGS. 3 and 4, a box-like body 20*a*, the body 20*a* having a plate member 21 suspending therefrom. There are four rollers 22*a*, 22*b*, 22*c*, and 22*d* rotatively supported by the plate member 21, the four rollers being arranged adequately away from each other vertically to produce a clearance corresponding to the rail member 17*c* thickness. Roller brackets 23*a*, 23*b* are provided, extending horizontally from the body 20*a* bottom toward the guide means 6, the brackets 23*a*, 23*b* supporting rollers 25*a*, 25*b* with a vertical rotary shaft (only single side shown). The four rollers 22*a* . . . 22*d* retain the rail member 17*c* therebetween and the two rollers 25*a*, 25*b* are to be positioned between the rail member 17*b* and the rail member 17*c* when the traction means 20 is supported by the guide means 6 that is, these six rollers 22*a*, . . . 22*d*, 25*a*, 25*b* movably support the body 20*a* of the traction means 20 movably, the Four rollers 22*a*, . . . 22*d* regulating the vertical position of the traction means 20 for and the two rollers 25*a*, 25*b* regulating the horizontal position. In addition, rollers 32*a*, 35*a*, which will be described later, are supposed to roll in the groove 6*a* formed between the rail members 17*a*, 17*b*. The traction means 20 is thereby supported erect without falling down or back or forth.

There is also provided a tubular member 26 suspended from the body 20*a* bottom, the tubular member 26 supporting a power supply member 29 to slidably contact the power supply cable 19*a* as shown in FIG. 3. The power supply member 29 is equipped with a contact to slidably connect to the power supply cable 19*a*. A cord 27 from the power supply member 29 reaches the body 20*a* through the tubular member 26.

On the other hand, an electric motor 30 is mounted erect in the body 20*a* as shown in detail in FIG. 4. The electric motor 30 is powered by way of the power supply cable 19*a*, power supply member 29 and cord 27. The electric motor 30 may be controlled by means of an invertor to accelerate or decelerate the driving speed, enabling the basket 100 to have a maximum traveling speed of 11 m/min, and make a slow start and to slow-down before stopping. There is mounted a gear box 31 under the electric motor 30, and an output shaft 31*a* projects horizontally from the gear box 31 toward the guide means 6. A drive sprocket 32 is secured to the output, shaft 31*a*, the sprocket 32 being engageable with the chain rack 16. Accordingly, as the electric motor 30 starts, the drive sprocket 32 will be driven to allow the traction means 20 supporting the sprocket 32 to travel along the guide means 6 equipped with the chain rack 16. As a result, the basket 100 coupled with the traction means 20 will ascend or descend the stairway 5 along the guide means 6.

The electric motor 30 is equipped with a brake (not shown), and the brake will work to stop the drive sprocket 32 when the power- supply to the electric motor 30 stops. Accordingly, the brake will be put into operation to lock the drive sprocket 32 and the traction means 20 will be prevented from traveling along the guide means 6 if the necessary steps are taken to stop the power supply to the electric motor 30, or in a case of a power failure. As a result, the basket 100 coupled with the traction means 20 will also stop on the guide means 6, and neither of the traction means 20 or the basket 100 will fall from the guide means 6 because of their dead load.

On the other hand, there is provided a follower shaft 33 in the body 20*a* of the traction means 20, the follower shaft 33 being as high as and in parallel to the output shaft 31*a* of the gear box 31 (as shown in FIGS. 4 and 5), and supported rotatively by the body 20*a*. A follower sprocket 35 is secured to the front end of the follower shaft 33, the follower sprocket 35 also being engageable with the chain rack 16 like the drive sprocket 32. The follower sprocket 35 thereby rotates as the traction means 20 travels. Moreover, there is a rotation speed detection disk (a means to detect rotation speed) 36 secured to a portion of the body 20*a* as shown in FIG. 5, the disk 36 being rotatable together with the follower sprocket 35 and follower shaft. 33. Further, the disk 36 has a lot of holes (not shown) drilled radially, and there is provided a photo sensor (a means to detect rotation speed) 37 in opposition to the holes with the disk 36 therebetween, so that the sensor can detect the rotational frequency of the disk 36.

There is provided a safety brake 39 at the rear end of the follower shaft 33, the safety brake 39 being operative when more signals than specified are inputted from the photo sensor 37. The safety brake 39 is equipped with a spring (not shown) pressed toward the brake operational direction. The safety brake 39 also works, like the brake in the electric motor 30, when the power supply is interrupted because of a power failure or for any other reason. If the safety brake operates, the follower shaft 33 and the Follower sprocket will be blocked from rotating, thereby stopping the traction means 20.

In addition, a roller 32*a* and a roller 35*a* are rotatively supported by the drive sprocket, 32 and the follower sprocket 35, respectively, and the traction means 20 may be thereby supported erect, keeping the chain rack engaged with the sprockets 32, 35.

As shown in FIG. 4, there is formed at the front of the traction means body 20*a* a coupling 40 for coupling with an attachment, (connecting means) 170 (together forming a coupling arrangement), the coupling 40 having an opening 41 formed in the body 20*a*. The opening 41 is crossed by a shaft member (coupling means) 42, and as the attachment 170 holds the shaft member 42, the basket 100 is coupled with the traction means 20 to be moved and to be supported so as to not to fall down toward this side. There is provided a photo sensor (position detecting means) 137 inside the coupling 40 to monitor how the shaft member 42 is coupled with the attachment 170. (The details will be given later, referring to FIG. 9 (*b*).)

Referring now to FIG. 6 through FIG. 15, the basket (carrier) 100 will be described. The basket 100 is supported movably by the guide means 6 and ascends or descends the stairway 5 as thrust by the traction means 20. The basket 100 for use in the present embodiment is equipped with a basket body (carrier body) K mounted with a roller support means 10.4 supporting a guide roller 117, and an attachment (coupling means) 170 to couple the body K with the traction means 20. In addition, the basket body K is foldable. When set up, it is composed of a bottom plate (base) 122, a frame (first frame) 101, another frame (second frame) 125, gangway boards 160, 161, the frames and plates being erect from the bottom plate, and shutting members 132, 132, extending between the frames 101, 125 to close the bottom plate 122 in four directions. The bottom plate is used to support a target object (a person or luggage).

A description of the roller support means 104 will follow, first in terms of the construction.

As shown in FIG. 6 (*b*), there are provided a bracket (body) 102 and a bracket (body) 103 at the top and the bottom of the frame 101 side respectively, The roller support 104 is rotatively secured to the shaft member 102*a* which is attached to the top bracket. 102, the roller support 104 being equipped with a <-shaped roller frame 105. The roller frame 105 is provided with a locking means L which is engageable with the bottom bracket 103 to secure the frame 105 in position (first position).

Figure 7A:
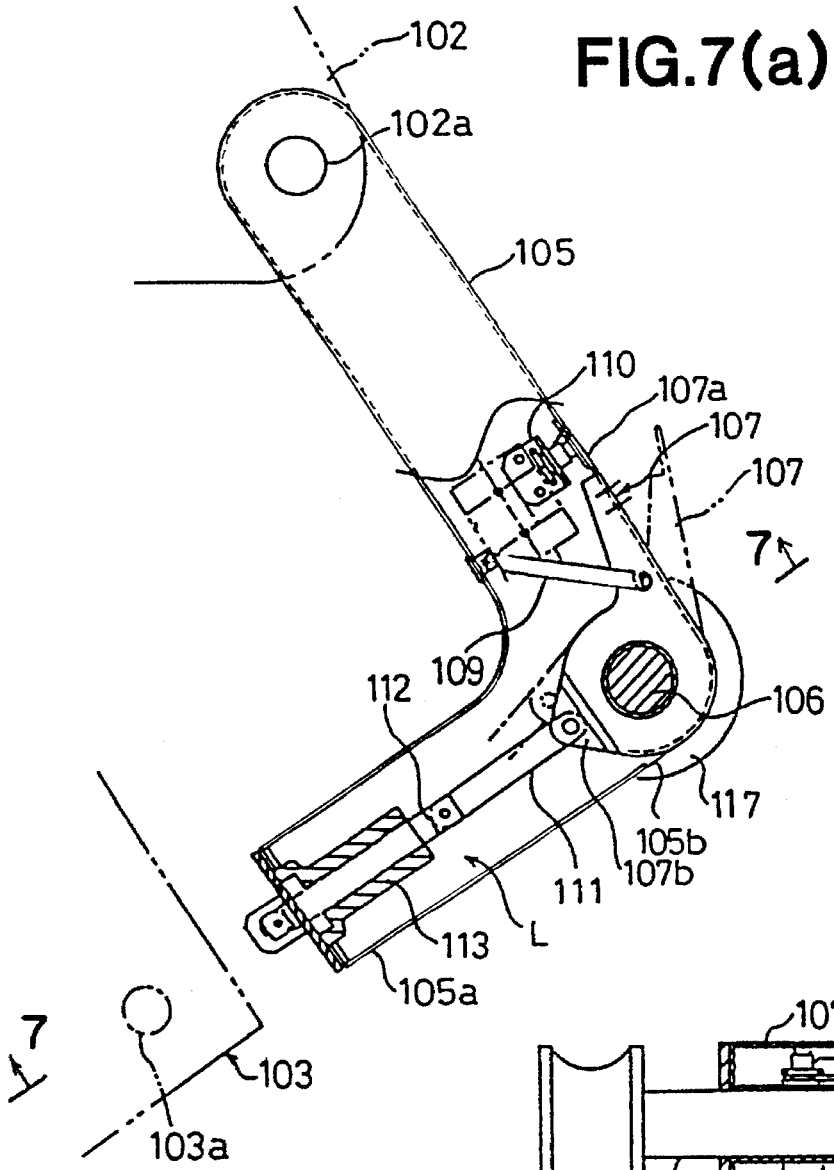
FIG. 7 (*a*) is a partially sectional view of the construction of a roller support and FIG. 7 (*b*) is a sectional view along line 7—7 of FIG. 7 (*a*).
Figure 7B:
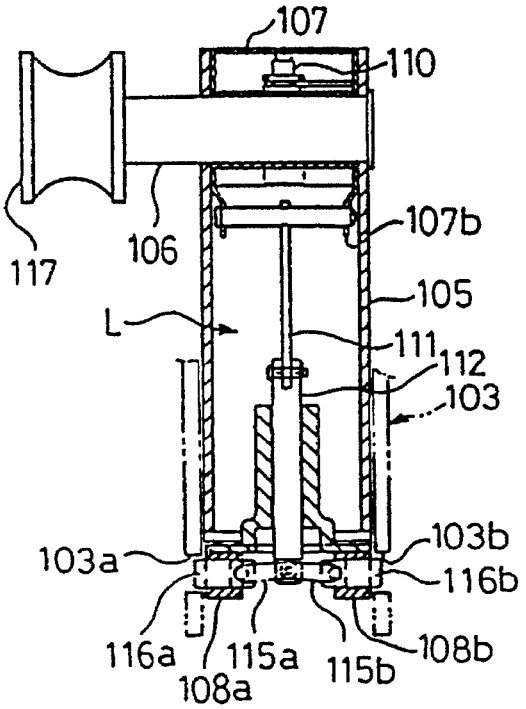

As shown in FIG. 7 (*a*) in detail, the roller frame 105 is hollow inside, and a shaft member 106 is secured to the middle portion 105*b* thereof, the shaft member 106 projecting from the roller frame 105 on one side, and the projection being supported rotatively by the guide roller 117. There is provided inside the roller frame 105 a lever 107 which is supported rotatively by the shaft member 106 while a spring 109 is interposed between the lever 107 and the roller frame 105 to press the lever 107 counterclockwise. The roller frame 105 is also equipped with a contact limit switch 110 to sense one end 107*a* of the lever 107. There is supported, on the other hand, a link member 111 which is rotatively supported by the other end 107*b* of the lever 107, the link member 111 rotatively supporting a link member 112. The link member 112 is also supported slidably by a guide member 11,3 which is attached to the roller frame 105, the link member 112 being designed to travel longitudinally toward the guide member 113. There are supported rotatively two sets of link members 115*a*, 115*b* by the front end of the link member 112 as shown in FIG. 7 (*b*), the link members 115*a*, 115*b* being linked with sliders 116*a*, 116*b* at their front ends. The sliders 116*a*, 116*b* are supported slidably by guide members 108*a*, 108*b* which is secured to the roller frame 105, the sliders 116*a*, 116*b* being designed to slide in the guide members 108*a*, 108*b* as the link member 112 moves. If the lever 107 is thereby biased by the spring 109, turning the limit switch 110 on (as illustrated by a solid line in FIG. 7 (*a*)), the sliders 116*a*, 116*b* project from the guide members 108*a*, 108*b*, respectively, at their front ends. When the lever 107 is rotated against the spring 109 (as illustrated by a 2-dot chain line in FIG. 7 (*a*)), the sliders 116*a*, 116*b* move by way of the link members 111, 112, 115*a* and 115*b* without projecting respectively from the guide members 108*a*, 108*b* at their front ends.

As illustrated by a 2-dot chain line in detail in FIG. 7 (*b*), the bottom bracket 103 has a clearance a little wider than the roller frame 105, and holes 103*a*, 103*b* which is drilled to receive the sliders 116*a*, 116*b*. In addition, the shaft member 118 is secured to the bottom of the bracket 103 as shown in FIG. 6 (*b*), the shaft member 118 projecting on one side as the shaft member 106. The projection is supported rotatively by a guide roller 119. The guide rollers 117, 119 are Japanese hand drum-shaped in section, are engageable with the roller guides 9, 10 which is circular in section. Once the guide rollers 117, 119 are put into engagement with the roller guides 9, 10, such engagement will be firm because the guide rollers 117, 119 are larger in diameter at their ends.

Figure 8A:
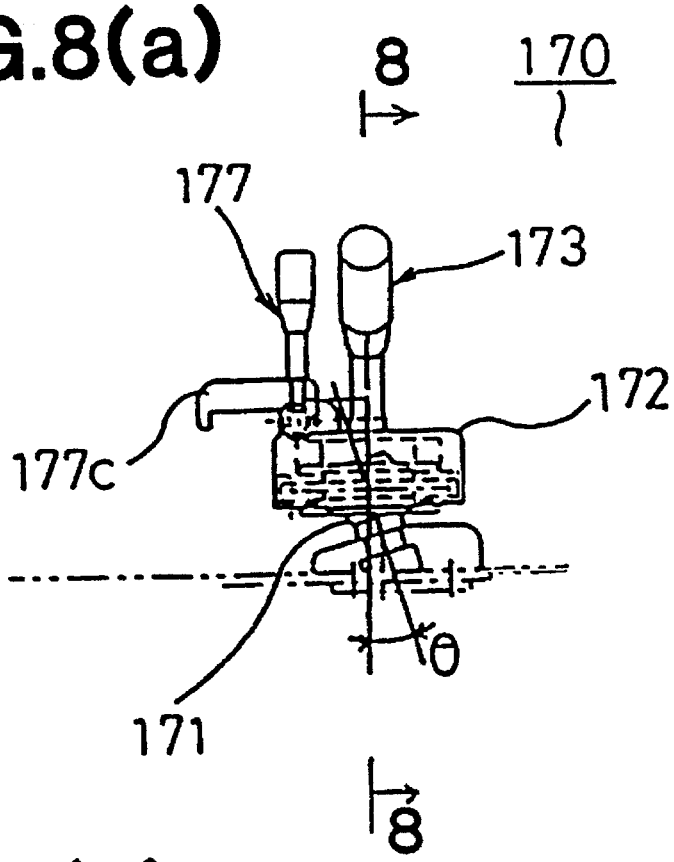
FIG. 8 (*a*) is a front view showing the construction of an attachment and FIG. 8 (*b*) is a sectional view along line 8—8 of FIG. 8 (*a*).
Figure 8B:
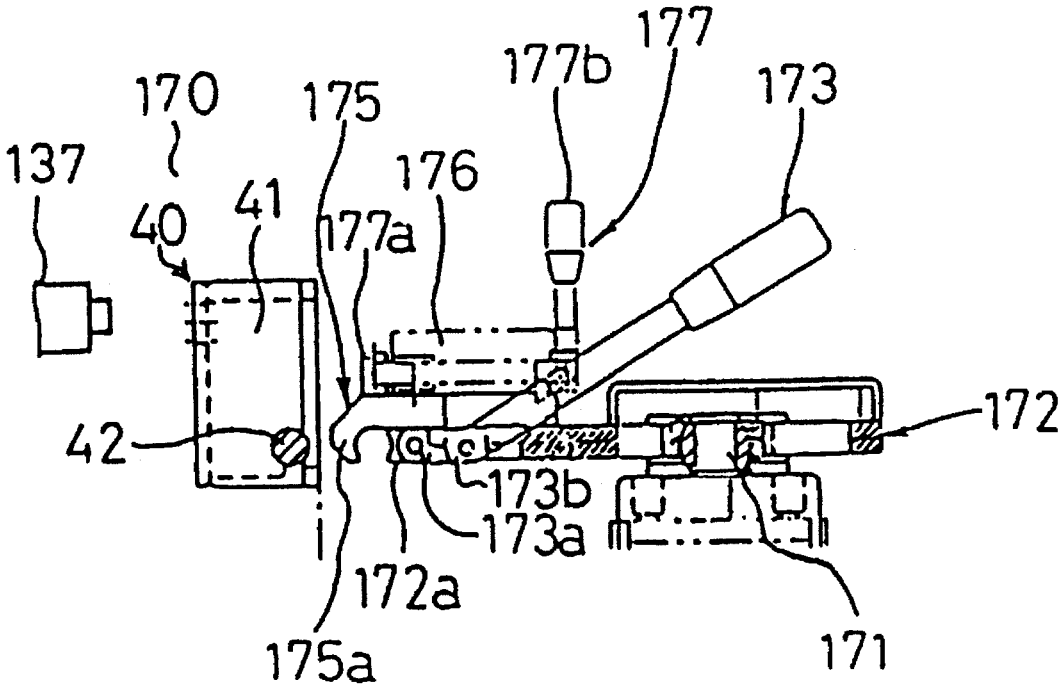
Figure 9A:
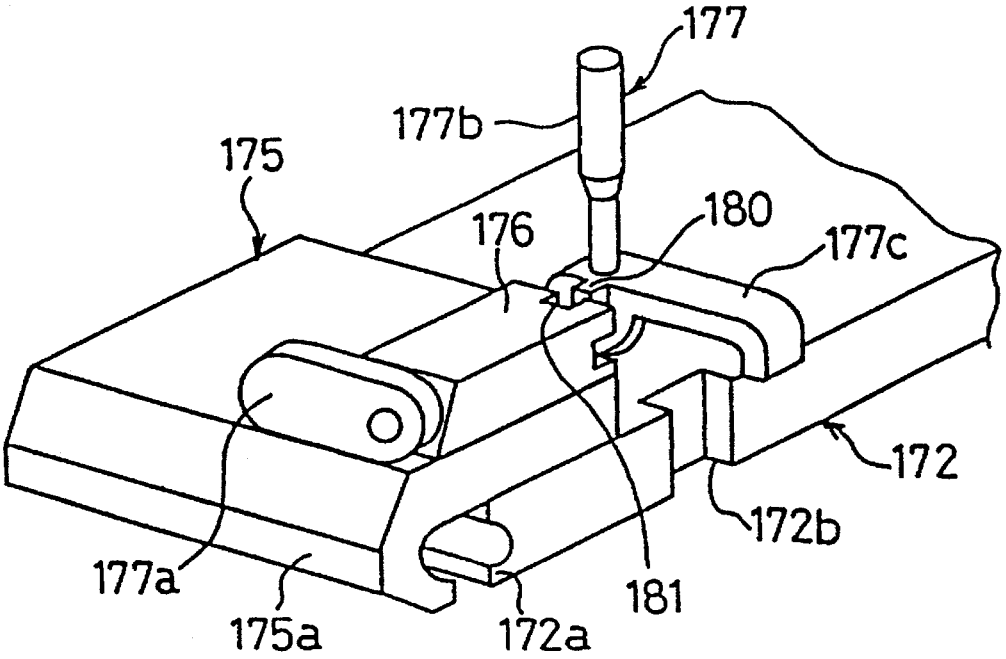
FIG. 9 (*a*) is a slant view showing the attachment base and nail member in detail, and FIG. 9 (*b*) is a slant view showing the locking member in rotation.
Figure 9B:
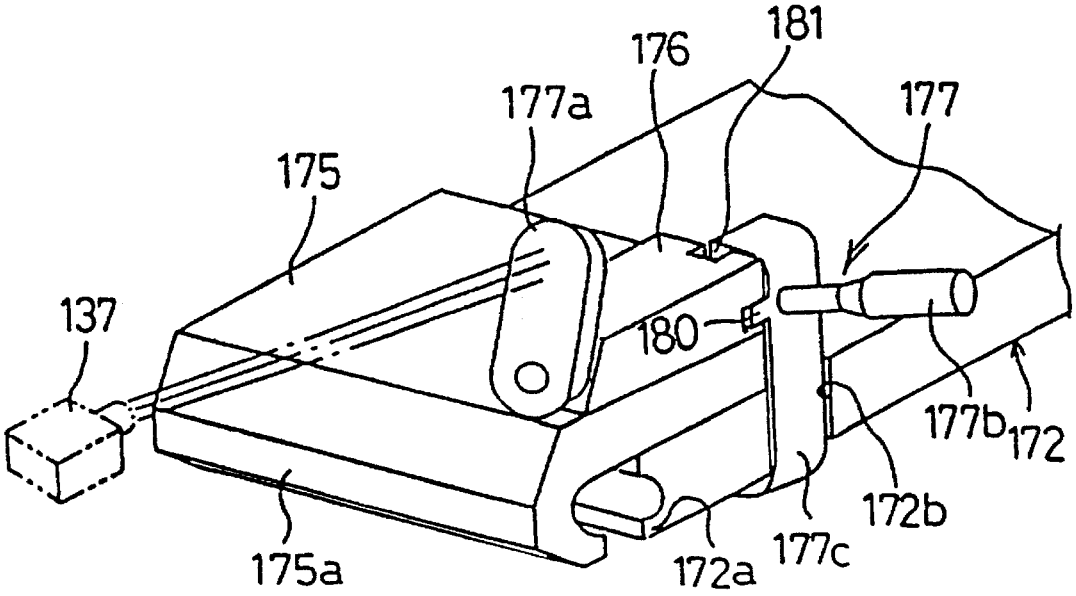
Figure 10:
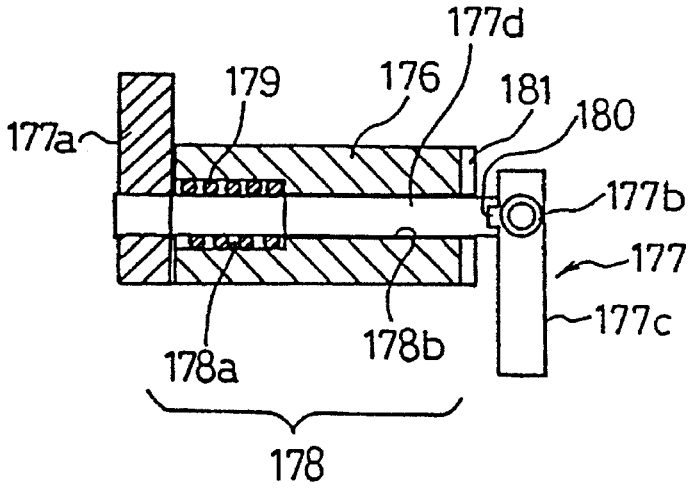
FIG. 10 is a vertical sectional view showing the construction of the locking member and holder member.

Referring now to FIG. 8 through FIG. 10, a description of the attachment (coupling means) will be given in connection with the construction.

The attachment 170 is, as shown in FIG. 8 (*b*), comprised of a base piece (a first clamp member) 172 to be attached onto the bracket 02 by means of a spherical bearing 171, a clamp lever (lever member) 173 being supported rotatively by the base piece 172 a nail member (a second clamp member) 175 being supported rotatively by the clamp lever 173, and a locking means 177 being supported rotatively by the nail member 175 and designed to secure the nail member 175 to the base piece 172. The clamp lever 173 is engaged with the base piece 172 with the center of rotation at the front end 173*a* of the clamp lever 173. The clamp lever 173 is engaged with the nail member 175 (with a center of rotation 173*b*) with a specified distance from the front end 173*a*. The reason why the spherical bearing 171 is provided between the base piece 172 and the basket body K is that the inclination of the traction means 20 changes when it ascends or descends as the traction means guide rail 17 changes in inclination, and the inclination of the shaft member 42 and that of the base piece 172 engageable with the shaft member 42 change accordingly. In contrast, the basket body K being supported by way of the guide rollers 117, 119 does not change in inclination, keeping an almost horizontal stance. It is then necessary to absorb a relative difference in angle being produced between the basket body K and the base piece 172.

In addition, the spherical bearing 171 is, as shown in FIG. 8 (*a*), so mounted as to incline only by an angle of theta (=15 degrees) within a plane in parallel to the side wall 5*a*. This is to enable the spherical bearing 171 which is mounted in advance to follow the base piece 172 for inclination because the base piece 172 inclines up to approximately 30 degrees while a general spherical bearing has an oscillation width of no more than +/−20 degrees. The base piece 172 is concave at the front end 172*a*, and has on one side a notch 172*b* which is engageable with a locking member 177 to be described later. (See FIG. 9 (*a*).)

On the other hand, the nail member 175 is bent at the front end 175*a* so as to be opposite to the front end 172*a* of the base piece 172, and concave at a portion opposed to the front end 172*a*. If the clamp lever 173 is brought down to follow the base piece 172 approximately, the front end 175*a* of the nail member 175 will move, getting near to the front end 173*a* of the clamp lever 173 so as to pinch the shaft member 42 with much force. Accordingly, the basket 100 will return to position, if a little off position, and the shaft member 42 will be held by bringing down the clamp lever 173. As shown in FIG. 9, there is mounted a holder member 176 at the top of the nail member 175, the holder member 176 being supported rotatively by the locking member 177. The holder member 176 has a hole 178 with a larger-diameter portion 178*a* and a smaller-diameter portion 178*b*, the hole 178 being fitted with a shaft 177*d* of the locking member 177 (see FIG. 10). In addition, there are provided at the rear end of the shaft 177*d* a Never 177*b* and a lock 177*c* as shown in FIG. 9 (*a*) and (*b*), the lever 177*b* and the lock 177*c* each projecting in the radial direction of the shaft 177*d*. There is formed at the base of the lock 177*c* an almost cross-shaped convexity 180 while there is provided in the holder member 176 an almost cross-shaped concavity which is engageable with the convexity 180. A screen 177*a* is attached to the front end of the shaft 177*d*, the screen 177*a* projecting in the radial direction of the shaft 177*d*. The lock 177 *c* designed to project in an almost opposite direction to the screen 177*a* because the lever 177*b* is to project at nearly 90 degrees as against the screen 177*a* also and the lock 177*c* is to project at nearly 90 degrees as against the lever 177*b*.

As shown in FIG. 10, a spring coil 179 is filled loosely onto a shaft 177*d* at the larger-diameter portion 178*a* of the perforated hole 178 to bias forwardly toward the locking member 177. Accordingly, the spring coil 179 biases the convexity 180 against the concavity 181 to maintain the locking member 177 in a non-rotational position. Since the lock 177*c* is bent downward at the front end, it is put into engagement with the notch 172*b* which is formed on one side of the base piece 172, as shown in FIG. 9 (*b*), preventing the base piece 172 and the nail member 175 from mutual movement.

In addition, while the lock 177*c* is engaged with the notch 172*b*, the screen 177*a* rotates to be erect so as to block the light path of the photo sensor (position detector) which is attached to the traction means 20. When the screen 177*a* is blocking the light path of the photo sensor 137, it is deemed that the basket 100 is normally coupled with the traction means 20, enabling the stairway lift to be operated properly. When the light path is not blocked, it will show that the coupling is not made adequately and control as specified will be made for safety.

The basket body K will now be described in detail, referring to FIG. 11 through FIG. 14.

Figure 11:
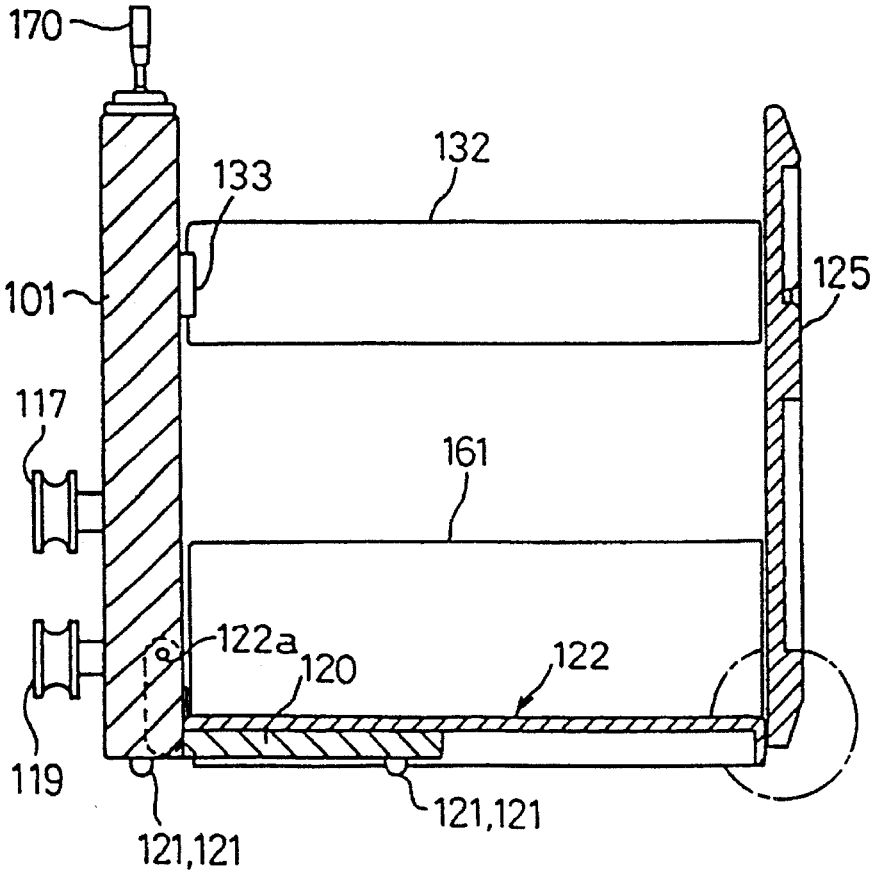
FIG. 11 is a sectional view along line 10—10 of FIG. 6 (*b*).

The basket body K is comprised of a frame 101 (a first Frame), another frame 125 (a second frame), a bottom plate (lift base) 122, gangway boards 160, 161 and shutting members 132, 132. Namely, as shown in FIG. 11, there is provided at the bottom of the frame body 101 a mobile base 20 almost rectangular in shape. Casters 121, 121, 121, 121 are attached to the bottom of the mobile base 120 to allow the basket 100 to be manually transported.

A bottom plate 122 is supported rotatively by the mobile base 120 with the center of rotation on the shaft member 122*a*, and a gas buffer 123 is provided between the mobile base 120 and the bottom plate 122 (see FIG. 6 (*c*)).

Figure 12:
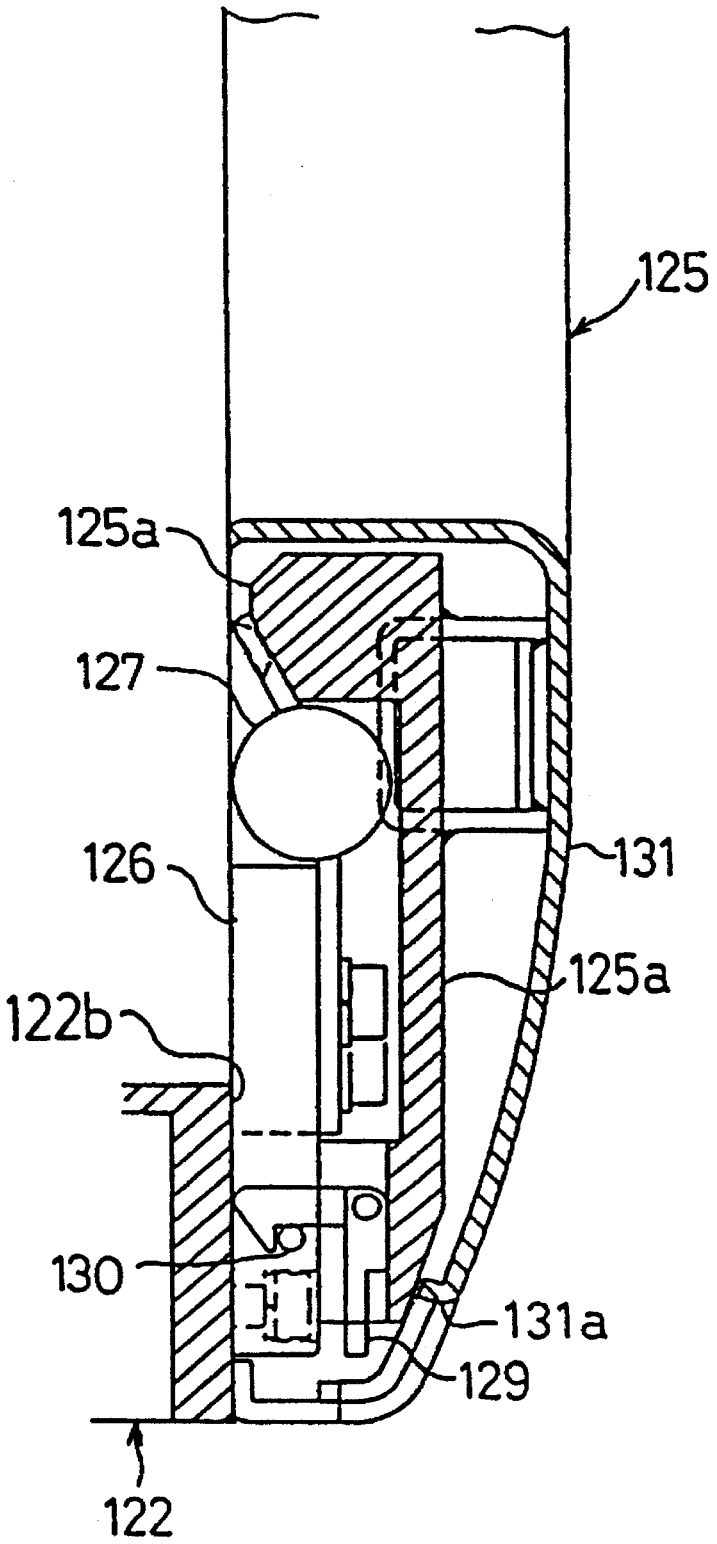
FIG. 12 is a detailed sectional view of the designated portion of FIG. 11.

In addition, the frame 125 is supported rotatively by the front end 122*b* of the bottom plate 122, as shown in FIG. 12. There is provided an erect sheet member 126 at the front end 122*b* of the bottom plate 122, the sheet member 126 being mounted with a frame 125*a* of the frame 125 by way of a hinge 127. There is rotatively supported a locking member 129 by the bottom end of the frame 125*a*, the locking member 129 being designed to engage with a pin provided projectingly on the sheet member 126 on the bottom plate 122. Further, these frames, including the frame 125*a*, are covered with an outer sheet 131, while an opening 131*a* is formed at the bottom of the outer sheet 131 to enable the locking member 129 to rotate.

The bottom plate 122 and the frame 125 are placed erect against the mobile base 120 by disengaging the locking member 129 with the pin 130 and folding the frame 125 toward the bottom plate 122 and then the bottom plate 122 together with the frame 125 toward the frame body 101 as shown in FIG. 6 (*c*) by a 2-dot chain line, and the basket 100 will be smaller in projection area. The hinge 127 is equipped with a hydraulic damper to absorb shock resulting from the rotation of the bottom plate 122, together with the gas buffer 123. There are provided an obstacle sensors 140 and 141 at the front end at the rear end of the frame body 101, and signals from the sensors are inputted to a control device (not shown), so that the electric motor 30 stops when there is any obstacle in the basket 100 traveling route.

What follows is a description of shutting members 132, 132 supported rotatively by both the top portions 101*a* of the frame body 101. As the shutting members 132, 132 are the same in construction and mounting, the shutting member 132 on only one side will be described with reference to FIG. 13 and FIG. 14.

Figure 13A:
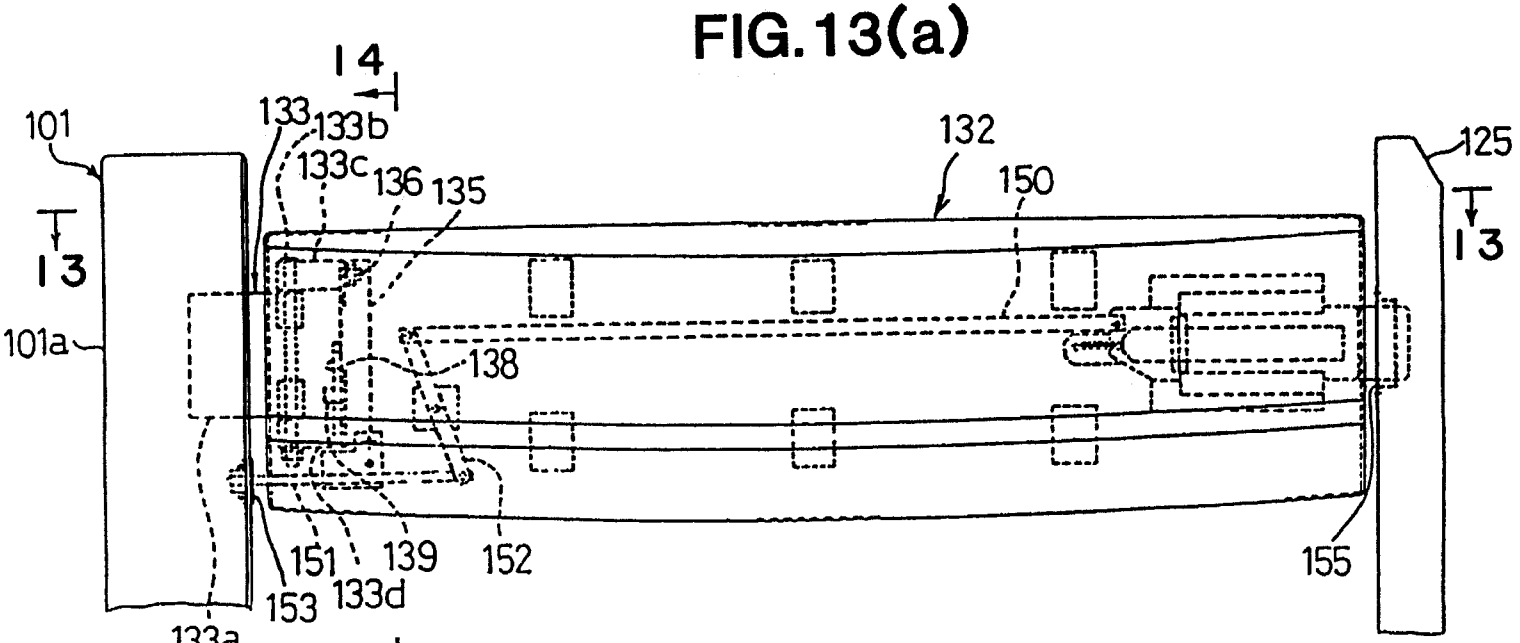
FIG. 13 (*a*) is a side view showing a shutting member and its mounting structure, and FIG. 13 (*b*( is a sectional view of in line 13 of FIG. 13 (*a*).
Figure 13B:
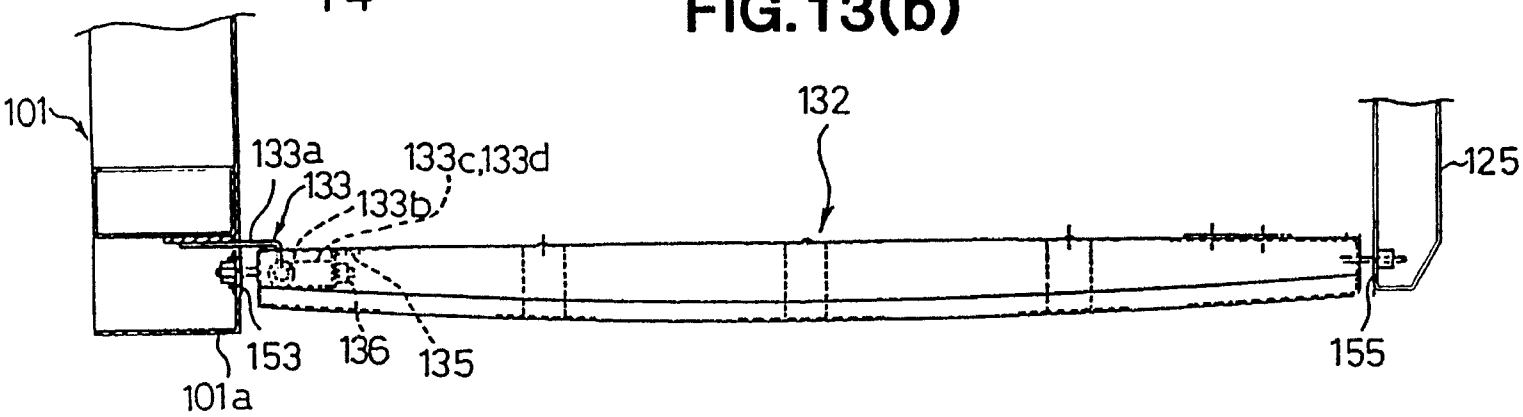

The shutting member 132 is attached to the top of the frame 101 by way of a hinge 133, and the hinge 133 is provided with a sheet member 133*a*, the sheet member 133*a* being vertically fitted with a hinge screw 133*b*. A tubular member 133c is supported rotatively for 180 degrees by the top of the hinge 133*b*, the tubular member 133*c* rotatively supporting an L-shaped member 135 by way of a bolt. 136. The L-shaped member 135 is fitted, as shown in FIG. 13 (*b*), on the shutting member 132, and consequently the shutting member 132 rotates horizontally not only with the hinge screw 133*b* being the central axis of rotation but also with the bolt 136 being an axis of rotation. There is provided a pin 139 projecting in the center of the L-shaped member 135, the pin 139 being designed to rotate centered on the bolt 136.

Figure 14:
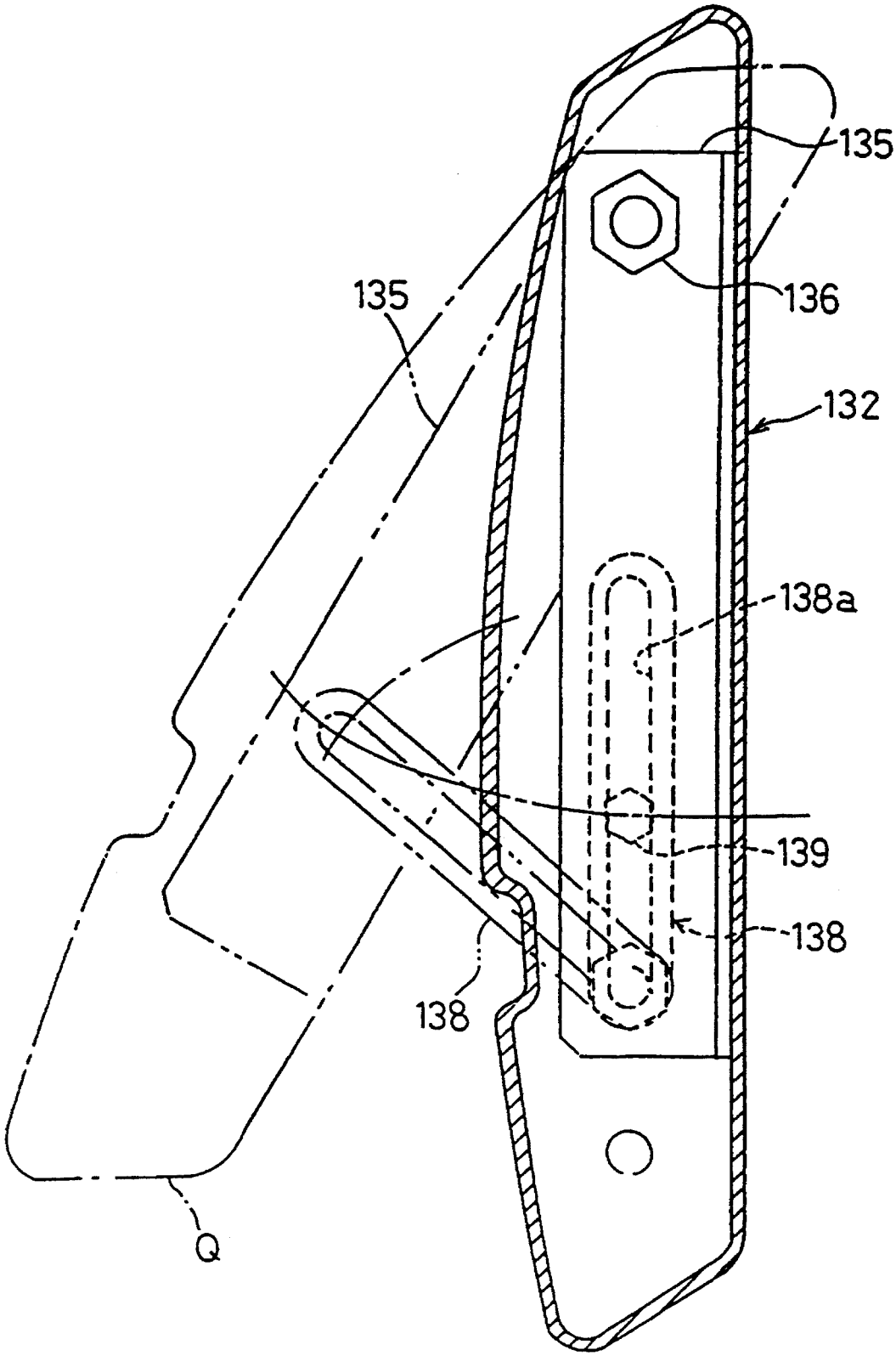
FIG. 14 is a sectional view along line 14—14 of FIG. 13 (*a*).

There is rotatively supported a tubular member 133d, similar to the tubular member 133*c*, at the bottom of the hinge screw 133*b*, the tubular member 133d rotatively supported an engagement member 138 having a long hole 138*a*. The long hole 138*a* is fitted with the pin 139 projecting from the L-shaped member 135 center as shown in FIG. 14 in detail. When the L-shaped member 135 rotates on the bolt 136, the pin 139 also pivots and the engagement member 138 engaged with the pin 139 is put into rotation centered on the tubular member 133d. The pin 139 then slides in the long hole 138*a*, and if the pin 139 reaches the edge of the long hole 138*a*, the L-shaped member 135 may not move any more, restricting the shutting member 132 for rotation. That is, the engagement member 138 and the pin 139 work to regulate the L-shaped member 135, ie. the, shutting member 132, to a for maximum rotational position (hereinafter called μmaximum oscillation position $Q^{11}$.

The shutting member 132 is, on the other hand, provided with two 2 locking members 150, 151 arranged to move in the longitudinal direction. The locking members 150, 151 are connected with each other by means of a rotatively supported link member 152 being. When the locking member 150 is moved to the extent that the front end projects from the shutting member 132, the locking member 151 also moves by way of the link member 152, allowing the front end of the locking member 151 to project from the shutting member 132. There are formed, in addition, engagement units 153, 155 in specified portions of the frames 101, 125. If the looking members 150, 151 are moved with the shutting member 132 from the maximum oscillation position Q, the units 153, 155 will engage with the locking members front ends, regulating the shutting member 132 for rotation and closing the frames 101, 125.

There are arranged front and rear gangway boards 160, 161 at the edges of the bottom plate 122 in its longitudinal direction. The boards 160, 161 are supported so as to be ready for opening and closing. If the boards 160, 161 are closed, they are maintained erect in the longitudinal direction of the bottom plate 123, closing the frames 101, 125. When the boards 160, 161 are open, a person on a wheelchair may get in the basket 100 as shown in FIG. 6 (*b*).

The gangway boards 160, 161 are supported in the following manner. There are provided, on the one hand, 4 (four) guide plates 162, 162, 162, 162 inside the bottoms of the frames 101, 125 supporting the gangway boards 160, 161 (see FIG. 6 (*b*)), the guide plates 162, . . . being provided with long holes 162*a*, . . . respectively (see FIG. 6 (*d*)). There are inserted in the long holes 162*a* pins 160*a* projecting From the gangway boards 160, 161 (opposite to the frames 101, 125), allowing the boards to be supported rotatively. On the other hand, these guide plates 162, . . . are provided with U-grooves 162*b* being engageable with a pin 160*b* projecting from the front gangway board 160. Accordingly, if the pin 160*b* is engaged with the U-groove 162*b*, the front, gangway board 160 is maintained erect. If the front gangway board 160 is moved to disengage the pin 160*b* from the U-groove 162*b* as the pin 160*a* moves in the long hole 162*a*, the front gangway board 160 will be rotational and able to open, as mentioned earlier.

Moreover, there are provided stop switches (not shown) at the top and bottom ends of the frame 101 and the guide means 6 to cause the basket to stop in case of emergency. The basket 100 may be connected with an operation box (not shown) by way of a cable to enable a station staffer to operate the basket 100 by handling the operation box and following the basket 100 when the stairway lift 1 is used.

A description of how the present embodiment works will follow.

If the stairway lift 1 is not used, the basket 100 may be folded and stored in place.

To fold the basket 100, it is necessary first to operate the handle (not shown), which attached to the shutting member 132, and move the locking member 150. The locking member 151 is also moved by way of the link member 152, allowing the front ends of the locking members 150, 151 to move into the shutting member 132. With this, the locking members 150, 151 are disengaged from the engagement units 153, 155, getting the shutting member 132 ready for rotation. The shutting member 132 is then rotated with the bolt 136 being the central axis of rotation and horizontally with the hinge screw 133*b* as the central axis of rotation, and the members 132 are arranged along the frame 101. Then the gangway boards 160, 161 are folded toward the bottom plate 122 side. The locking member 129 is disengaged from the frame 125, allowing the frame 125 to rotate and the bottom plate 122 to rotate as against the frame 101. While the Frame 125 and the bottom plate 122 rotate, the gas buffer 123 acts to fold them slowly. The roller support means 104's lever 107 is rotated clockwise against the spring 109, and the sliders 116*a*, 116*b* move by way of the link members 111, 112, 115*a*, 115*b*, causing the front ends of the sliders to not project from the guide members 108*a*, 108*b*. If the roller frame 105 is then rotated clockwise on the shaft member 102*a*, the roller frame 105 moves into the bottom bracket 103 to take the second position N.

The basket 100 thus may be stored in place as folded. To use the stairway lift 1, it is necessary for a station staffer to take out the basket 100 from where it is stored, and transport the basket 100 manually to the lower end of the guide means 6 at the stairs.

FIG. 15 shows how the traction means 20 is moved to the lower end of the guide means 6 to connect with the basket.

It is necessary first to move the basket so that the attachment 170 may be in opposition to the opening 41 of the traction means 20, and bring down the clamp lever 173 toward the traction means 20 (as shown by the arrow D in FIG. 15 (*a*)), and then the clamp lever 173 rotates with the front end 173*a* being the center of rotation. As it rotates, the nail member 175 moves as shown in FIG. 15 (*a*), The clamp lever 173 is brought down further to engage the front end 175*a* of the nail member 175 with the shaft member 42. If the clamp lever 173 is then pulled toward you (FIG. 15 (*c*)), the clamp lever 173 toggle joint will generate force in the direction so that the base piece 172 and the nail member move toward near. The traction means 20 with the shaft member 42 secured thereto does not move at this time because the means is supported by the guide means 6. Accordingly, it is the basket 100 with the attachment 170 mounted that moves, and the shaft member 42 is held between the base piece 172 and the nail member 175. Since the base piece 172 is originally set to be as high as the shaft member 42, the front end 172*a* of the base piece 172 is readily engageable with the shaft member 42.

When the clamp lever 173 is brought down further, the nail member 175 is close to the base piece 172 as shown in FIGS. 9 (*a*) and (*b*). If the lever 177*b* of the locking member 177 is brought down toward you with force against the spring 179, the lock 177*c* rotates to be engaged with the notch 172*b* of the base piece 172, preventing the nail member 175 and the base piece 172 from mutual movement, making the screen 177*a* at the front end of the nail member 177 erect and blocking the light path to the photo sensor 137. When the lever 177*b* is released, the locking member 177 is pressed by the spring 179 so as to move to engage the convexity 180 with the concavity 181, the locking member 177 being prevented from rotating.

As mentioned above, with the clamp lever 173 down, the toggle joint allows the basket 100 to move nearer to the guide means 6, and the roller frame 105 is at the second position N and the guide roller 117 is lower in position than usual. Because of this the guide roller does not interfere with the roller guide 9. Since the roller guide 10 is extended straight at the edge as shown in FIG. 6 (*b*), the roller guide 10 is lower than the mounting height of the guide roller 119 below. Consequently, the roller guide 119 does not interfere with the roller guide 10 even though the guide roller 119 is in place. The guide rollers 117, 119 enter the concavity 8 where the roller guides 9, 10 are formed without interfering with the guides. If the roller frame 105 is rotated to a first position M as shown in FIG. 6 (*b*) (normal position M) and secured, using the rock mechanism L, with this the top guide roller 117 only is engaged with the roller guide 9, allowing the basket to be movably supported along the guide means 6.

The bottom plate 122 and the frame 125 are now turned to set up the basket 100. The downstairs shutting member 132 and the front gangway board 160 are made open and the upstairs shutting member 132 and the rear gangway board 161 are closed (see FIG. 6 (*b*)).

After the stairway lift 1 user (a person on a wheelchair, for example) gets in the basket 100, the front gangway board 160 is closed and fastened by means of a clasp. Then the shutting member 132 is closed. The shutting member 132 is rotated horizontally first until the frames 101, 125 are closed, and then oscillated vertically to the maximum oscillation position Q (see FIG. 14). With this, the locking members 150, 151 in the shutting member 132 are made to fit into the engagement units 153, 155 (see FIG. 13), so that these locking members 150, 151 are moved to fasten the shutting member 132 to the frames 101, 125. The basket 100 is thereby surrounded in four directions with the gangway boards 160, 161 and the shutting members 132, 132.

After this, the electric motor 30 in the traction means 20 is started by operating the operation box which is connected to the basket 100. The moment, the electric motor 30 starts, the drive force is transferred to the drive sprocket 32 by way of the gear box 31. As the drive sprocket. 32 is engaged with the chain 15 which is fitted onto the guide means 6, the traction means 20 itself moves along the traction means guide rail 17. The thrust force given by the traction means 20 is transferred to the basket 100 by way of the shaft member 42 and the attachment 170 to enable the basket 100 to move with the top guide roller 117 being engaged with the roller guide 9. The bottom guide roller 119 is not, engaged with the roller guide 10 at this time, but they get engaged with each other gradually as the basket 100 travels, because the roller guide 10 is formed rightward upward.

When the basket moves and the guide rollers 117, 119 are engaged with the roller guides 9, 10, respectively, the basket and the person in the basket are supported by an engagement such that the guide roller 117 is pressed from below against the roller guide 9 and the guide roller 119 from the top against the roller guide 10. Since the guide rollers 117, 119 are larger in diameter at their ends, the roller guides are also affected by force produced in the axial direction of rotation. The space between the roller guides 9, 10 is not constant from the downstairs 2 to the upstairs 3 of the stairway 5, but changes so as to keep a specified relation there between. This is because the basket being supported by way of the guide rollers 117, 119, should move with the bottom plate 122 being kept horizontal. The attachment 170 transmits thrust from the traction means 20 to the basket 100 and receives moment tending to upset the basket 100 in order that the basket 100 may not fall in a direction such that it gets away from the guide means 6. In addition, the clamp, when released, opens the rear gangway board 161 and the shutting member 132 on the upstairs 3 side to let the user get off the basket upstairs.

After this, the traction means 20 and the basket 100 are moved to the downstairs 2 to stop them at the end of the guide means 6 by operating the operation box again. The lock mechanism L of the roller support 104 is then released to rotate the roller frame 105 to the second position N, where the top guide roller 117 is not engaged with the roller guide 9. The front and rear gangway boards 160, 161 are Folded then toward the bottom plate 122, and the shutting members 132, 132 are rotated to the storing position. Further, the frame 122 and the bottom plate 125 are moved to fold the basket 100. By unlocking the locking member 177 and operating the clamp lever 173, the traction means 20 is disconnected from the basket 100. With this, the basket may move freely from the guide means 6, and be transported manually to the place where it is to be stored. This shows accordingly that what is left on the stairway 5 is only the guide means 6 being fastened along the side wall 5*a* in addition to the traction means 20 being arranged between the guide means 6 and the side wall 5*a*.

Since the follower sprocket 35 is engaged with the chain 15 arranged in the guide means 6, the sprocket rotates as the traction means 20 travels. The rotation of the follower sprocket 35 is transferred to the disk 36 being secured to the follower shaft 33 by way of the same. The disk 36 is provided radially with a lot of holes, the photo sensor 37 being so arranged in opposition to the holes as to detect the revolution frequency of the disk 36. The photo sensor 37 generates such frequency pulses as correspond to the revolutional frequency of the disk 36, namely, the traveling speed of the traction means 20. A control circuit (not shown) packaged in the traction means 20 compares the pulses measured by the photo sensor 37 with the datum pulses (delay time limit pulses generated from the measured ones). Accordingly, if the electric motor 30 brake goes wrong or the object loaded on the basket 100 is so heavy that the electric motor is short of torque to the degree that, the traction means 20 exceeds the specified speed, the control circuit will judge that something is wrong, turning the safety brake 39 power off. The brake will then be put into operation to stop the follower shaft 33 and the follower sprocket 35. As the sprocket. 35 is engaged with the chain 13, the traction means 20 will stop.

Let's see then what are the effects of the first embodiment as mentioned above.

The stairway lift 1 of the present embodiment may be readily installed only by constructing the guide means 6 along the stairway and mounting the guide means 6 with the basket 100 and the traction means 20. Therefore, the stairway lift 1 does not need any large-scale civil engineering and building work when installing, unlike an elevator or an escalator, but may be provided with minimum incidental work. It does not cost much or take a long time for construction. The stairway lift 1 is not a conventional type which is mounted onto the side wall of a stairway, but onto the tread 5*a* of the stairway 5. It is not necessary, therefore, to take into consideration the strength of the side wall when installing the stairway lift 1. It can be installed even onto a stairway without any side wall but only with a handrail.

Although the basket 100 is arranged as projecting from the guide means 6 it can be detached from the guide means 6 when it is not in use. Consequently, the basket 100, when detached, does not interfere with passers-by on the stairway 5. If the stairway is wide enough only to let the basket 100 go up and down, the stairway lift 1 of the present embodiment may be installed. When the basket is disconnected, the stairway is available as an ordinary stairway for passers-by.

Since the traction means 20 is housed, on the other hand, between the side wall 5*a* and the guide means 6, it does not interfere with passers-by. The guide means itself has almost no protrusions, and passers-by are not hindered, even with traffic congestion. In addition, as the roller guides 9, 10 are accommodated in the concavity 8 being formed in the guide means 6 without projecting outwardly, they do not interfere with passers-by going up and down the stairway 5 or soil their clothes. Further, the hand rail 12 provided at the top end of the guide means 6 may be available for the passers-by when going upstairs and downstairs. The basket, 100 is not constructed so as to move in the space S between the guide means 6 and the side wall 5*a*. This suggests that the space S is sufficient if it is wide enough only for the traction means to travel, and the guide means 6 may be installed in close proximity to the side wall 5*a*. As a result, the guide means 6 may minimize the space for installation and the interference with the traffic of passers-by.

Power to the electric motor 30 is given by moving the power supply point where the power supply cable 19*a* is in contact with the power supply member 29, and the electric motor 30 is not directly cabled with the power supply. Accordingly, there is no possibility of cable intermingling as the traction means 20 travels. The electric motor 30 depend on inverter based control for acceleration and deceleration, which ensures that the basket 100 with a smooth start and stop. The photo sensor 37 works to detect how fast the basket 100 travels, and the safety brake is put into operation in response to the signal from the photo sensor 37. As a result, even if something is wrong with the sensors and the control circuit causes the basket 100 to travel at a speed exceeding the specified scope of speed, the safety brake will operate to stop the basket, 100 and the basket 100 will not fall and hurt the user and passers-by near the basket.

The attachment 170 provided with the clamp lever 173 readily couples the basket 100 with the traction means 20 without using any tool. With a toggle joint, the clamp lever 173 may adequately move the basket 100 to allow it to couple with the traction means 20 even if the basket 100 is a little out of position. This is because coupling is made with ease without giving any fine adjustment to the basket 100 position. In addition, the locking member 177 of the attachment 170 prevents the nail member 175 and the base piece 172 from mutual movement, which assures a proper engagement of the attachment 170 with safety. Since the rotational position of the locking member 177 is detected by means of the photo sensor 137, safety control may be provided even if the locking member 177 is on the brink of releasing. This will eliminate any possible danger.

The basket body K is supported by the guide rollers 117, 119 so as to keep a horizontal posture when moving, without, inclining while transporting a person on a wheelchair or luggage. It is not necessary to linearly form the roller guides 9, 10 to allow the basket K to move in such a manner.

Consequently, the stairway lift according to the present invention may be installed on a stairway even with a landing, regardless of the construction of the stairway itself. The traction means 6 changes in posture when leading the basket 100 as the guide rail 17 changes in inclination angle. The attachment 170 coupled with the traction means also changes in posture. As a result, there will be produced a relative difference in angle between the basket body K that is being kept horizontal and the attachment 170 being changeable in posture, but such a difference in angle may be absorbed by means of the spherical bearing 171 interposed between them, allowing the basket. 100 to travel gently.

The guide roller 117 is readily engageable with the roller guide 9 by only moving the roller frame 105 since the frame is movably supported on the basket body K and the guide roller 117 is supported rotatively by the frame 105.

Accordingly, the basket 100 may be attached to and detached From the guide means 6 without difficulty. In addition, the basket body K is engageable with the guide means 6 if the bottom end of the means 6 does not, protrude because the roller frame 105 is mounted onto the basket body K so that the frame 105 projects toward the upstairs side. As a result, the guide means 6 does not interfere with the traffic of passers-by by any protrusion at the bottom end.

As seen above, the basket 100 is foldable and may be transported manually, minimally interfering with traffic, and needs less space for storing. The basket 100 is equipped with the gangway boards 160, 161, which enable the user on a wheelchair to get on and off the basket himself even if there is a difference in height between the floor surface and the bottom plate 122. Besides, the frames 101, 125, being arranged laterally at both ends of the basket 100, are available as handrails to help the user in a wheelchair get on or off the basket 100 without difficulty. The basket 100 opens, by construction, longitudinally at the both ends, allowing the user to get in from one side and off from the other one. This enables the user to get off the basket 100 to the upstairs 3 only by moving the basket 100 to the place where the front end of the gangway board 161 reaches the upstairs 3. As a result, the guide means 6 may be shorter in overall length, and in particular, it is possible to prevent the top edge of the guide means 6 from projecting toward the upstairs 3 and interfering with the traffic of passers-by.

There are provided stop switches on the basket 100 and at both ends of the guide means 6, and any of the user or passers-by may push any of the switches without delay in case of emergency. In addition, the gas buffer 123 is arranged between the bottom plate 122 and the mobile base 120 while the bottom plate 122 is connected with the frame body 125 by means of the hinge 127 having a built-in damper.

This makes, accordingly, it possible to fold the basket gently. As the shutting members 132, 132 are supported rotatively and horizontally by the hinges 133, 133, they do not interfere with the basket when it is folded. There are provided a lot of sensors in the present embodiment, including obstacle sensors 140, 141 to put the stairway lift 1 in case of emergency for the safety of the user of the basket 100 and passers-by.

As seen above in the embodiment, the attachment 170 is rotational with the built-in spherical bearing 171 to keep the traction means 6 from affecting the basket 100 when it changes posture while traveling. It is not to be understood, however, that this is the only way to absorb influential changes in posture of the traction means 20. If the shaft member 42 on the traction means 20 side is made rotational, the member 42 is be available for this purpose.

The roller frame 105 is supported rotatively by the basket body K according to the above-mentioned embodiment, but it may be also possible for the frame 105 to move using any other mechanism. In addition, it is intended in the embodiment that only the guide roller 117 changes in position. But it is also possible to make the other guide roller 119 move.

The basket 100 is attached and detached on the downstairs 2 in the present embodiment, but if the guide means 6 is extended to the upstairs 3, the basket 100 may be attached and detached there, too.

Figure 16:
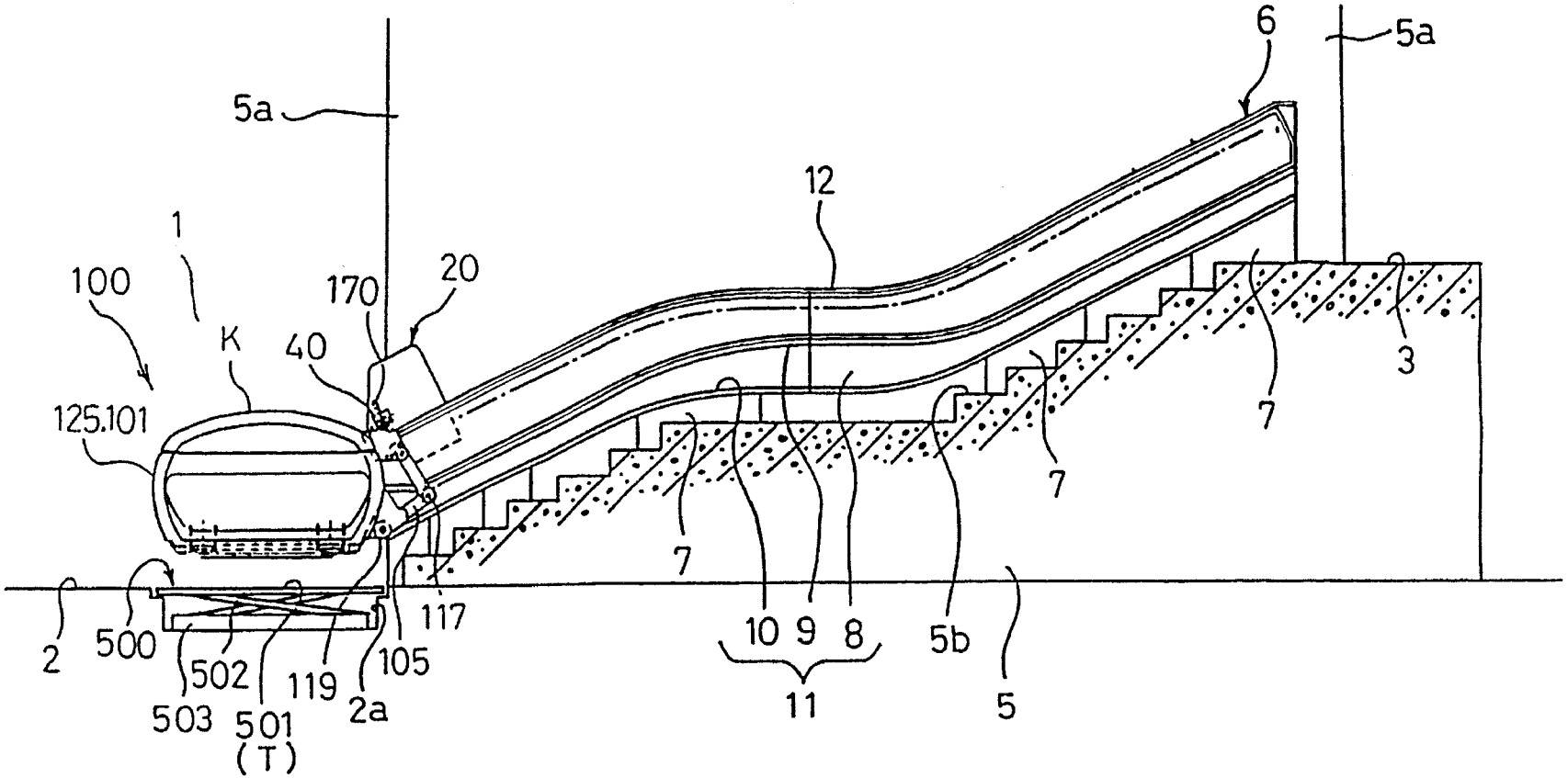
FIG. 16 is a front view showing another embodiment of the present invention.
Figure 17A:
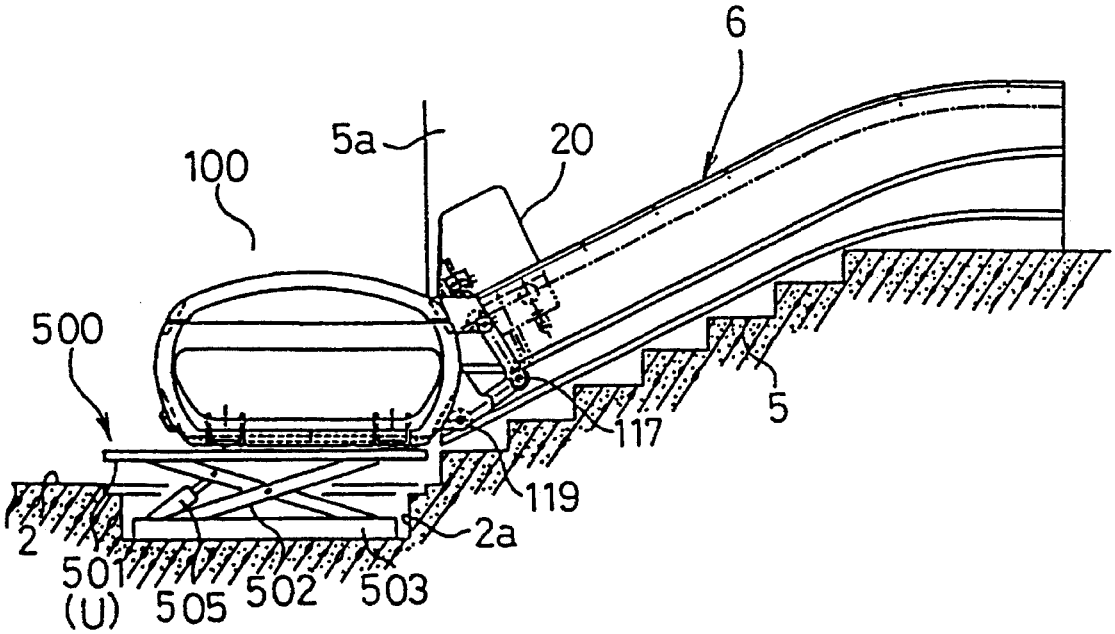
FIG. 17 (*a*) is a view showing a basket coupled with a traction means and FIG. 17 (*b*) is a plan view of FIG. 17 (*a*).
Figure 17B:
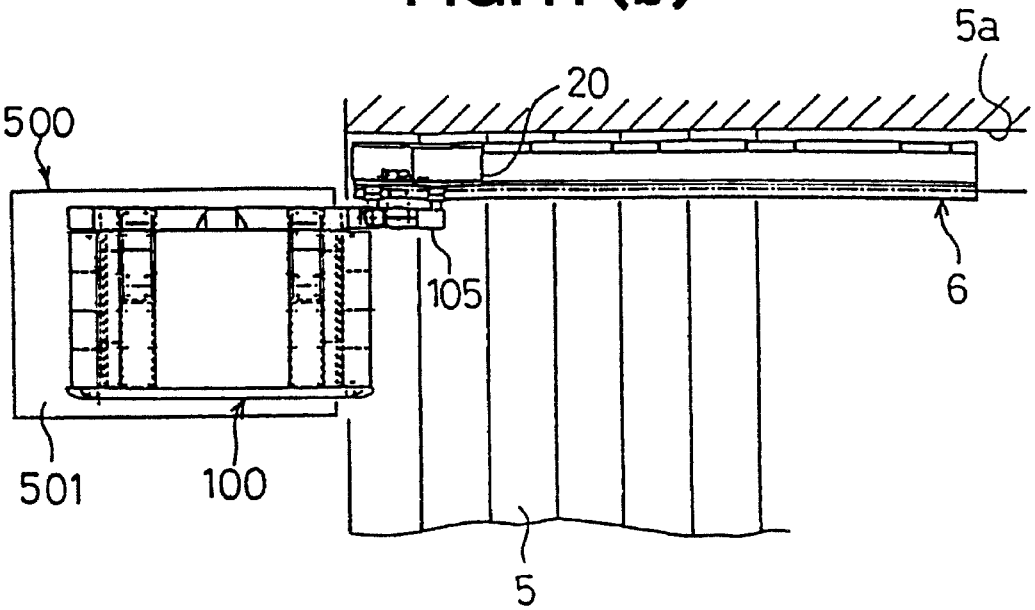
Figure 18:
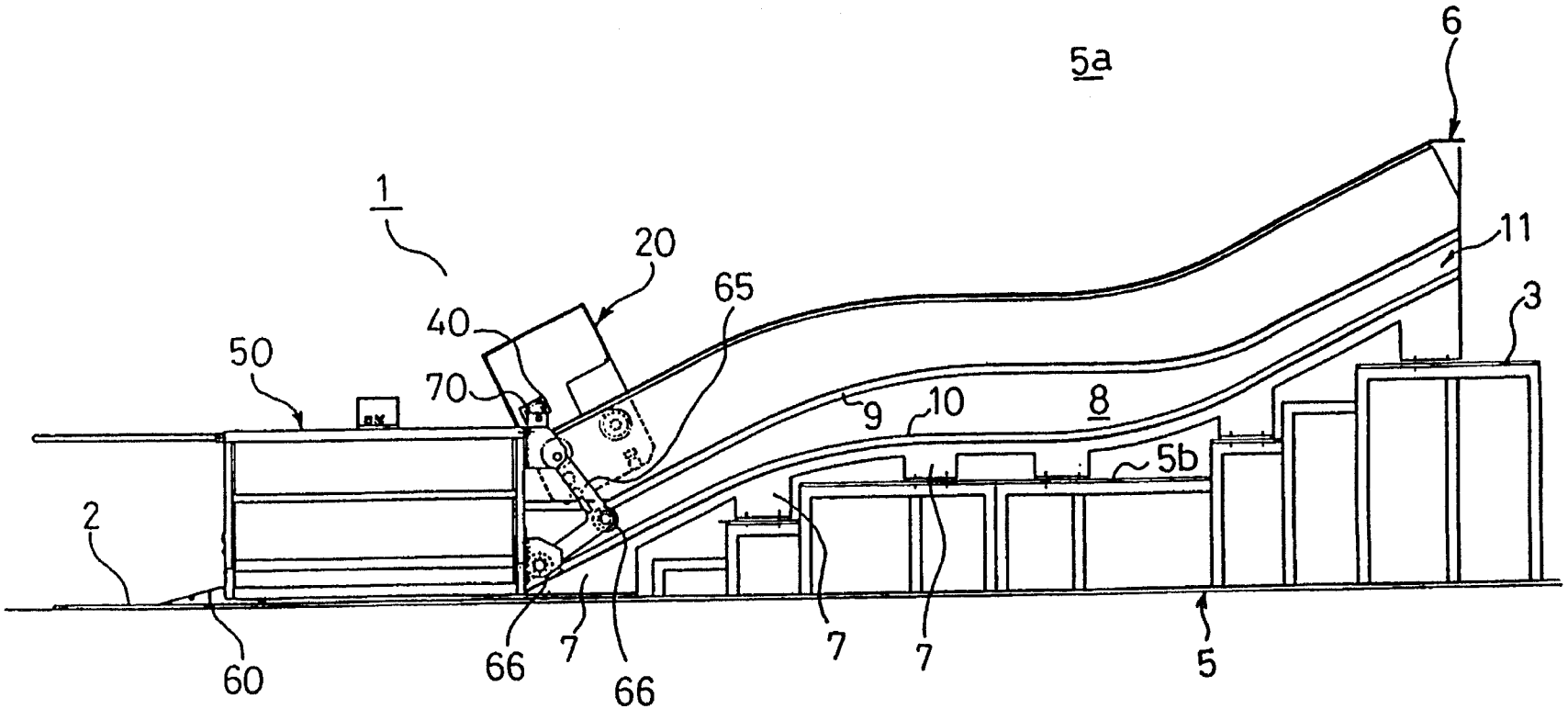
FIG. 18 is a front view of another embodiment of the present invention.

Referring now to FIG. 16 and FIG. 17, there is shown another, second embodiment of the present invention. The same parts as shown in FIG. 1 through FIG. 15 have the same symbols with no further explanation.

FIG. 16 shows a lift means 500 near the bottom of the guide means 6 at the downstairs 2 of the stairway 5 in the embodiment, the lift means 500 being available for the attachment and detachment of the basket (carrier) 100 to and from the traction means (mobile body) 20. The stairway 5 as shown in FIG. 16 has no side wall 5*a* near the top and the bottom, and there is formed a different passage (such as a concourse) to cross the stairway passage orthogonally, but the top and bottom ends of the guide means 6 for use with the present, embodiment do not protrude toward such a passage (see FIG. 17 (*b*)).

First, FIGS. 17 (*a*) and (*b*) illustrate the construction of the lift means 500.

The lift means 500 is provided in a concavity 2*a* being formed on the downstairs 2 of the stairway 5 and comprises a stage (carrier stage) 501 for receiving the basket, 100 thereon. The stage 501 is supported so as to be able to move vertically by means of a paragraph support means 502 while the bottom end of the support means 502 is supported rotatively by a base piece 503. There is provided a hydraulic cylinder (drive means) 505 between the base piece 503 and the support means 502 below the stage 501, the hydraulic cylinder 505 being coupled with a hydraulic source (not shown). With the hydraulic cylinder 505, the stage 501 can selectively take a down-position T (see FIG. 16) proximate the floor surface of the downstairs 2 and an up-position U (see FIG. 17 (*a*)) to lift the basket 100 for coupling with the traction means 20.

Let's see then how the embodiment works.

The basket 100 may be stored, folded as in the first embodiment. To use the stairway lift 1, the basket 100 as folded is taken out by a station staffer from where it is stored and transported manually to the vicinity of the bottom of guide means 6. The basket 100 is then put and set up on the stage 501 installed on the downstairs 2. The stage 501 is at the down-position T at this time and close to the floor surface of the downstairs 2.

The hydraulic cylinder 505 of the lift means 500 is then driven to let the stage go up to the up-position U. The shaft member (coupling means) 42 of the traction means 20 having, moved to the guide means 6 bottom, is almost as high as the attachment (coupling means) 170 attached to the basket 100. The basket 100 is ready and coupled with the traction means 20 and the guide means 6 by operating the clamp lever 173 and the roller frame 105 as described in the foregoing embodiment (see FIG. 17 (*a*)). After the basket 100 is supported by the guide rollers 117, 119, the hydraulic cylinder 505 of the lift means 500 is driven to return the stage 501 to the down-position T. The concavity 2*a* formed in the downstairs 2 is thereby closed by the stage 501, and the traffic of passers-by on the downstairs 2 (such as a concourse) is not hindered.

After this, the traction means 20 is driven, the basket 100 is moved to the upstairs 3 and the user is allowed to get down from the upstairs 3 as in the foregoing embodiment by operating the operation box. In addition, the basket 100 is moved to the downstairs 2 by operating the box again. Then the hydraulic cylinder 505 is driven to bring the stage 501 to the up-position U to put the basket 100 on the stage 501. The basket is then folded and disconnected from with the guide means 6. The hydraulic cylinder 505 is then driven to bring the stage 501 down and the basket 100 is transported to be stored. Since the stage 501 is at the down-position T, the lift means 500 is as embedded in the downstairs 2 floor, causing no interference with the traffic of passers-by.

A description of the effects of the present embodiment will follow.

The present embodiment is as effective as the foregoing embodiment. In addition, the present embodiment enables the basket 100 to go up for attaching and detaching purposes, which makes it unnecessary for the guide means 6 bottom to be extended to the vicinity of the downstairs floor surface.

Accordingly, the guide means 6 does not project from the side wall 5*a*, avoiding interference with traffic even when the side wall 5*a* of the stairway 5 is not provided in the vicinity of the bottom thereof. The lift means may be stored under the downstairs 2 floor when not in use, and does not interfere with the traffic of passers-by.

As mentioned above, the basket 100 which is foldable is used, but another basket which is not, folded may also be used. In addition, the stage 501 in the present embodiment is driven by means of the hydraulic cylinder 505, but the stage may also be driven by any other drive means.

In the meantime, the carrier and the coupling means for use with the present invention are not limited to the basket 100 and the attachment 170 as illustrated in the foregoing embodiment. Another embodiment using a basket 50 and an attachment 70 that are different in construction will be described with reference to FIG. 18 through FIG. 24. The same parts as shown in FIG. 1 through FIG. 15 have the same symbols, for omitting further explanation.

Figure 19:
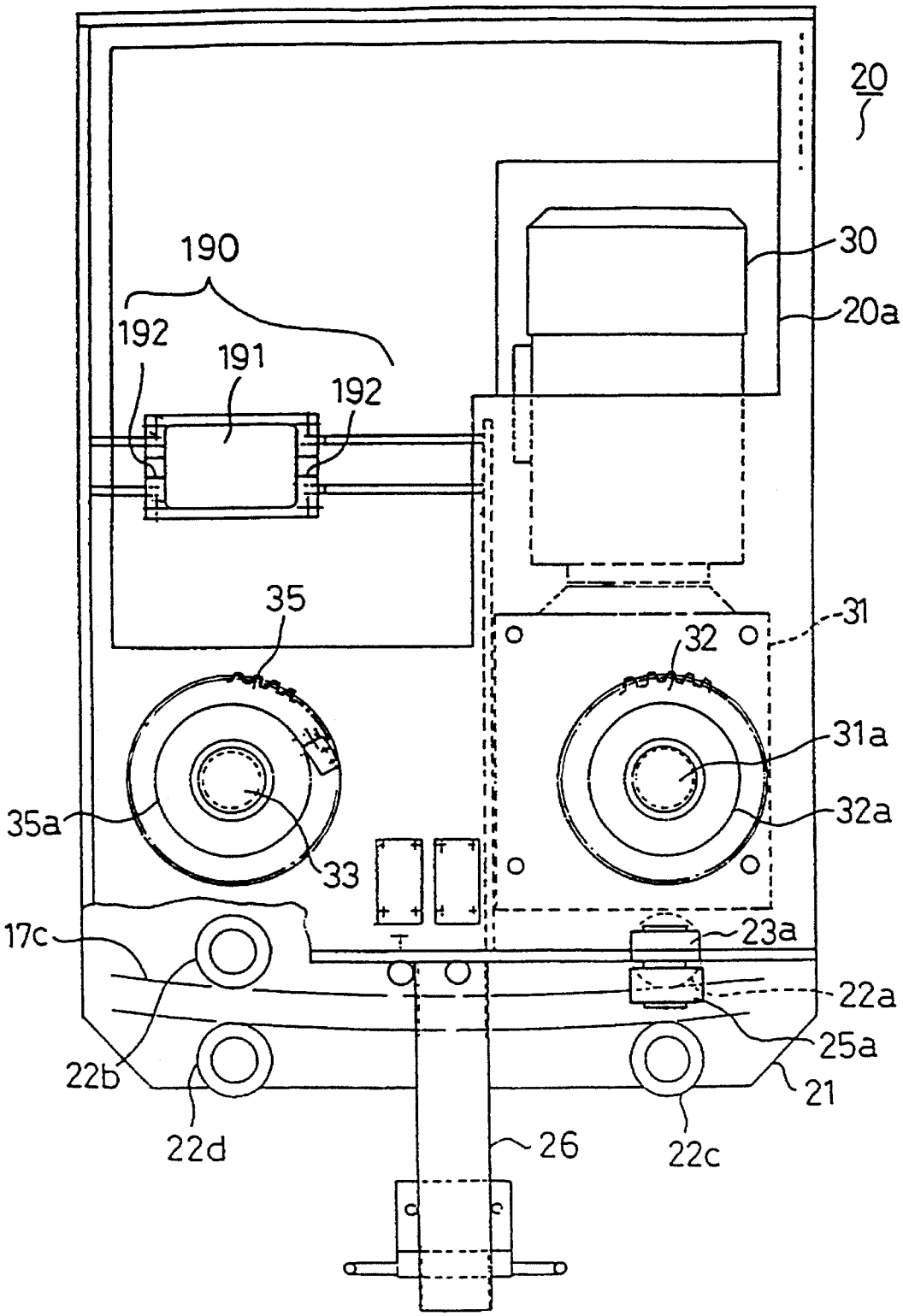
FIG. 19 is a front view of a traction.

As shown in FIG. 19, there is formed a couplee (coupling means) 190 in front of the traction means 20*a* according to the present embodiment, the coupling to link with the attachment (coupling means) 70. The coupling 190 is provided with a rectangular opening 191 with holes 192, 192 formed in both adjacent walls thereof. The holes 192, 192 are designed to be linked with the attachment 70, which will be illustrated later.

Figures 20A, 20B, 20C:
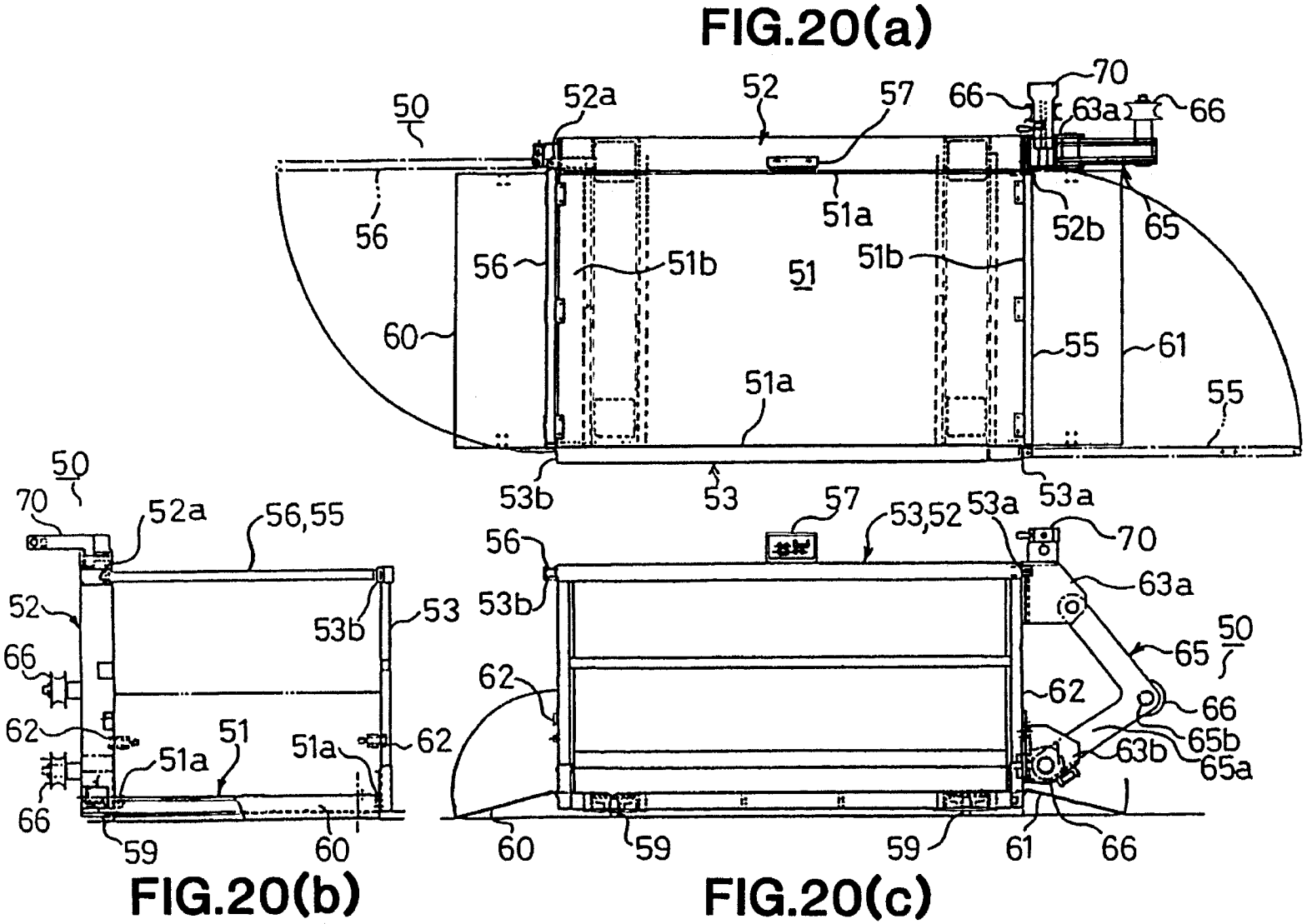
FIG. 20 (*a*) is a plan view of a basket, FIG. 20 (*b*) is a side view thereof, and FIG. 20 (*c*) is a front view thereof.
Figure 22:
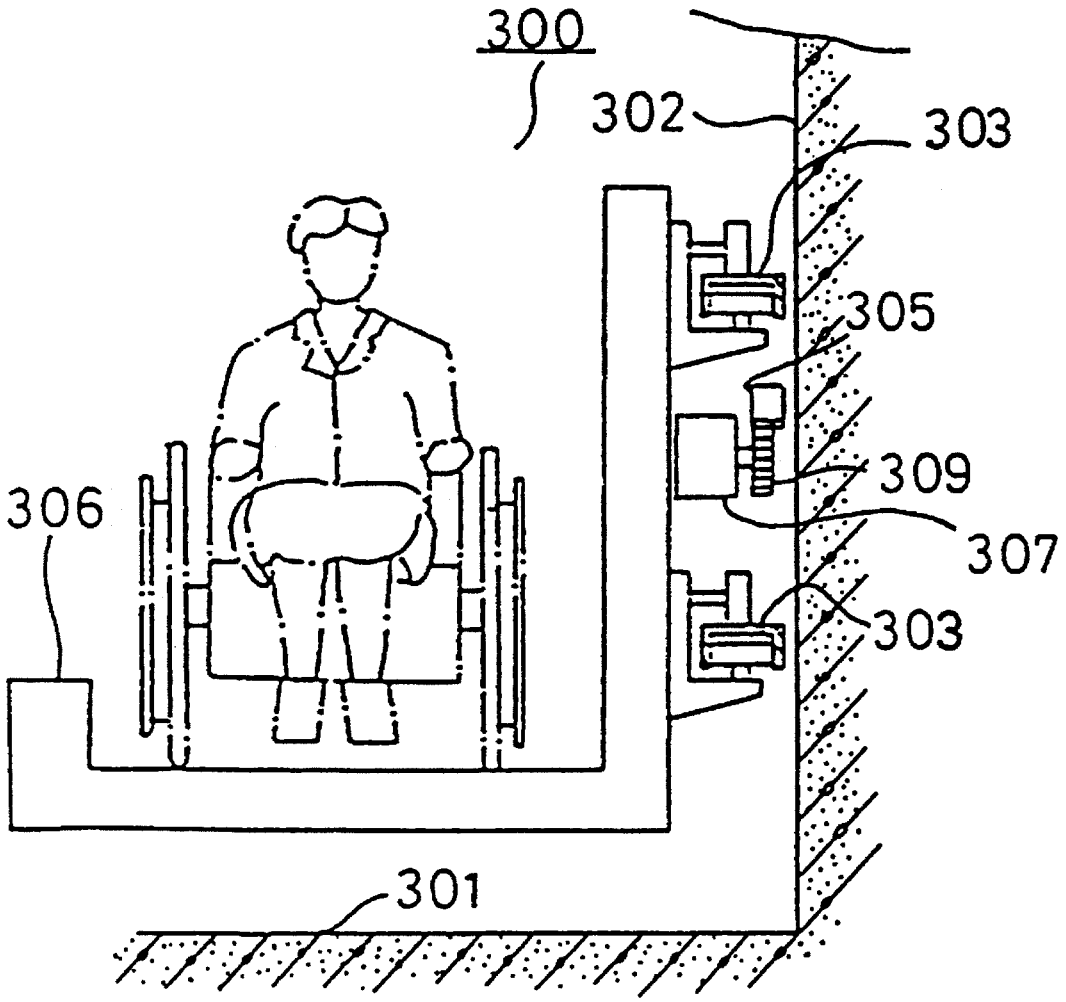
FIG.22 PRIOR ART
FIG. 22 is a view of a first conventional stairway lift.
Figure 23:
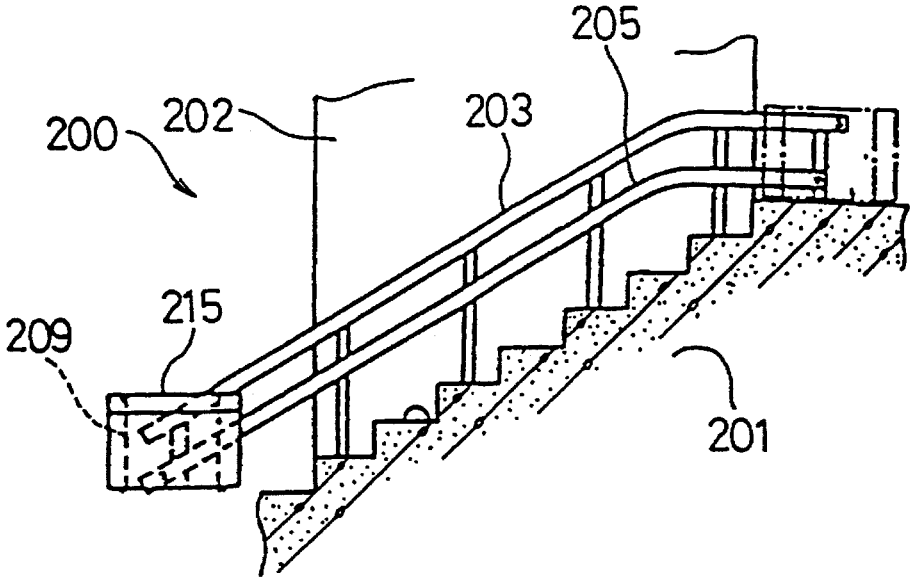
FIG.23 PRIOR ART
FIG. 23 is a view of a second conventional stairway lift.
Figure 24:
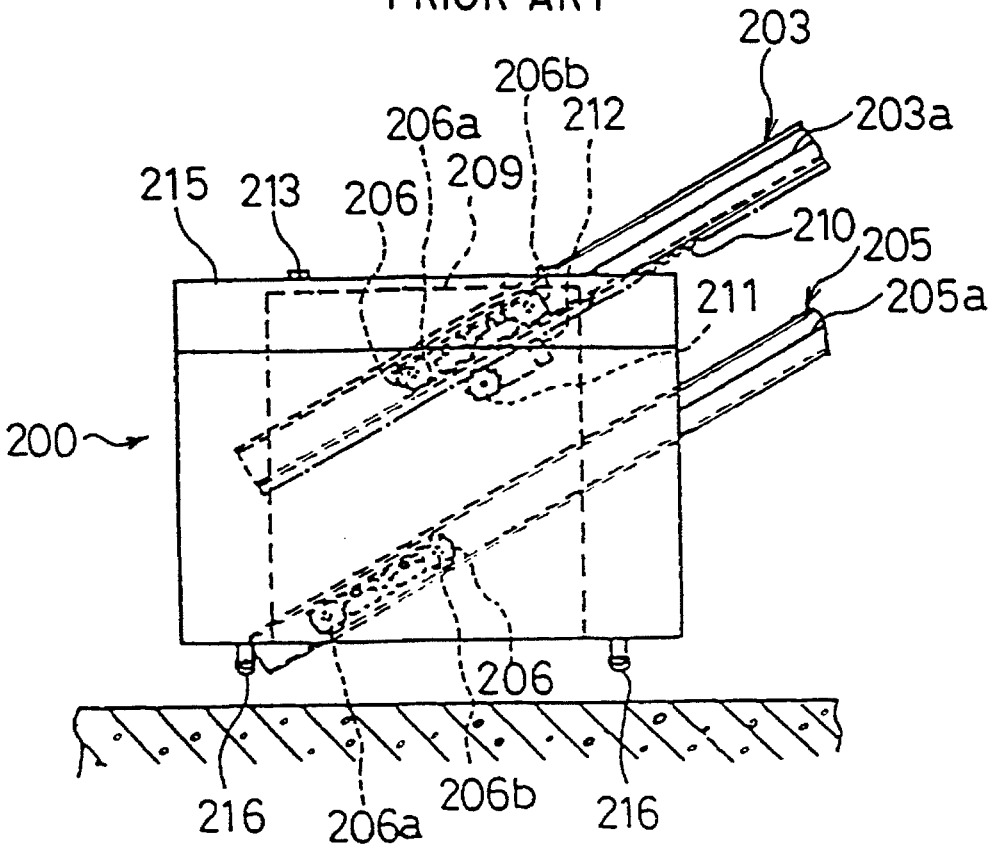
FIG.24 PRIOR ART
FIG. 24 is a detailed view showing the mounting construction of a carrier.
Figure 25:
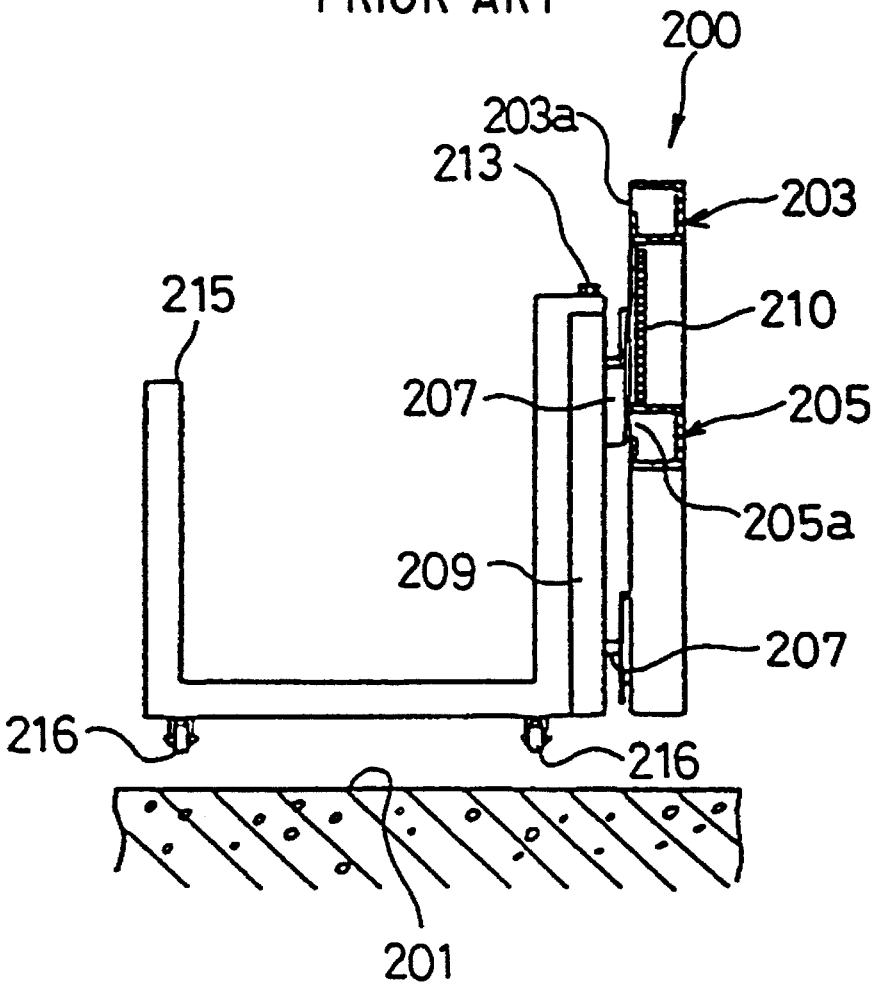
FIG.25 PRIOR ART
FIG. 25 is a sectional view showing the mounting construction of a carrier.
Figure 26:
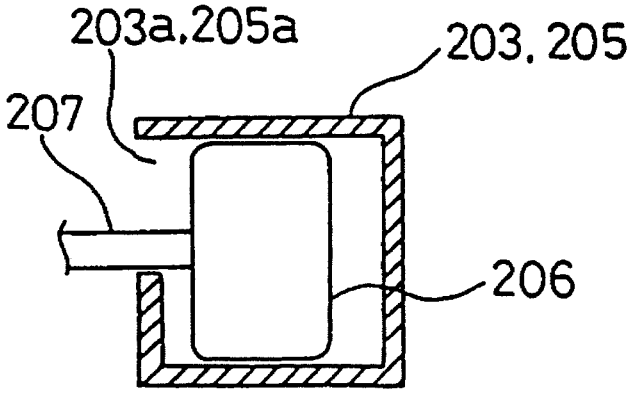
FIG.26 PRIOR ART
FIG. 26 is a view showing the support construction of a guide roller.

FIGS. 20 (*a*), (*b*), and (*c*), will be referenced to explain the basket 50 of the present embodiment.

The basket 50 is equipped with a bottom plate (entrance base) 51 with ladder frames (first and second frames) 52, 53 provided erect laterally at the both sides thereof. Shutting members 55, 56 are supported rotatively by the top corners 52*a*, 53*a* of the frames 52, 53. The other top corners 52*b*, 53*b* are engageable with the front ends of the shutting members 55, 56. By engaging the shutting members 55, 56 supported by the frames 52, 53 with the opposing top corners 52*b*, 53*b*, the basket 50 is surrounded in four directions. In addition, there are attached four casters 59, 59, 59, 59 one each at the four corners at the rear of a base (not shown) arranged under the bottom plate 51 to enable the basket 50 to be manually transported.

A front and a rear gangway board 60, 61 are supported rotatively by the both longitudinal end of the bottom plate 51*b*, 51*b*. When the boards are opened as shown in FIG. 20 (*c*), the user on a wheelchair may get in the basket 50.

The gangway boards 60, 61 and the frames 52, 53 are provided with a clasp, one each, so that the boards may be secured to the frames 52, 53 for storing as erected.

There are secured brackets 63*a*, 63*b* to the top and bottom of the frame 52 side, the brackets 63*a*, 63*b* being equipped with a <-shaped roller frame 65 therebetween. The bottom of the roller frame 65 may be engaged and disengaged with the bracket 63*b* by using the same mechanism as shown in FIG. 7. The roller frame 65 itself is so constructed as to be folded. There is rotatively supported a guide roller 66 in the middle 65*b* of the roller frame 65.

There is supported rotatively another guide roller 66 by the bottom bracket 63*b*. The guide rollers 66, 66 are hand-drum shaped for engagement, with the roller guides 9, 10 and are almost circular in section to allow the guides to withstand the basket 50 and the horizontal load.

The attachment (coupling means) 70 is mounted onto the top Face of the top bracket 63*a*. As shown in detail in FIG. 21 (*b*), the attachment 70 is equipped with a channel member 71 secured to the top bracket and a pair of sheet members 72, 72 attached to the channel member 71, the sheet members being opposite to each other at a specified interval. There is mounted a cylindrical shaft member 73 between the sheet members 72, 72, the shaft member 73 supporting rotatively and slidably an attachment body 76 by way of a spherical bearing 75.

As illustrated, the attachment body 76 is almost, L-shaped in vertical section, and equipped with a hole 76*a* formed in the longitudinal direction thereof. There is formed a hole 76*b* at the front end of the attachment 76 in the longitudinal direction thereof, the hole 76*b* being connected with the hole 76*a* to form a hollow that is almost a T-shape. There is formed, in addition, a guide groove 82 in the center of the attachment body 76 as shown in FIG. 21 (*a*), the guide groove 82 being provided with a vertical groove 82*a* formed along the hole 76*a* for connecting the perforated hole 76*a* with the outside.

There are also formed a pair of lateral groove portions 82*b*, 82*c* from both ends of the vertical groove portion 82*a* toward the side of the attachment body 76. The guide groove 82 is thus composed of the vertical groove portion 82*a* and a pair of the lateral groove portions 82*b*, 82*c*, and formed to be U-shaped in horizontal section.

There is movably inserted, on the other hand, a slider 77 in the hole 76*a*, a lever 78 projecting from the slider 77 in the radial direction thereof. The lever 78 protrudes to the outside of the attachment body 76 by way of the guide groove 82 and is formed to rotate and move in the lateral groove portions 82*b*, 82*c*, centering on the slider 77 shaft when rotating (see the arrows F1, F2 in FIG. 21 (*c*)), or in the vertical groove portion 82*a* in the longitudinal direction of the attachment body 76 (see the arrows G1, G2 in FIG. 21 (c)). As the lever 78 rotates in the arrows F1, F2 directions, the slider 77 rotates in the same directions. If the lever 78 moves toward the arrows G1, G2, the slider 77 will move in the hole 76*a*.

There are rotatively supported two link members 79, 79 by the front end of the slider 77, the link members 79, 79 rotatively supported stopper members 80, 80 at the front ends thereof. The stopper members 80, 80 have a spring 81 between them and they are slidably supported by the above-mentioned hole 76*b*. The front end of the attachment body 76 having the stopper member 80, 80 thereinside is formed smaller than the opening 191 of the traction means 20 in order that the front end may be inserted in the opening 191. The stopper members 80, 80 are designed and dimensioned to be inserted in the holes 192, 192 formed adjacent the opening 191.

Therefore, the slider 77 moves in the perforated hole 76*a* toward the attachment body 76 front end to push out, the link members 79, 79, projecting the stopper members 80, 80 connected therewith from the side of the attachment body 76 when the lever 78 is positioned at the front end of the vertical groove portion 82*a* or in the lateral groove portion 82*b* formed continuously with the front end. Position the lever 78 at the rear end of the vertical groove portion 82*a* or in the lateral groove portion 82*c* formed continuously with the rear end, and the slider 77 will move in the hole 76*a* toward the rear end of the attachment body 76, pulling in the link members 79, 79 to prevent the stopper members 80, 80 coupled therewith from projecting from the side of the attachment body 76.

There is fitted a stop switch (not shown) onto the frame body 52 to pause the basket 50 in case of emergency. There is also provided a basket panel 57 on top of the frame 52 to display as required how the basket 50 is operated. An operation box (not shown) may be connected by cable with a basket 50 to enable the staffer to handle the basket 50 while going with the basket when the stairway lift 1 is used. In addition, there are also provided stop switches (not shown), one each, on the top and bottom ends of the guide means 6 so as to stop the basket 50 in case of emergency.

Let's see then how the present, embodiment works. The stairway lift 1 is now ready for use. The basket 50 is taken out by a station staffer from where it is stored and transported manually to the bottom end of the guide means 6 on the downstairs 2. The guide rollers 66, 66 supported by the roller frame 65 and the bracket 63*b* of the basket 50 are engaged with the top roller guide 9 and the bottom roller guide 10, enabling the basket 50 to be supported movably by the guide means 6.

With the lever 78 of the attachment 70 fitted onto the basket 70 positioned in the lateral groove portion 82*c*, the attachment 70 is held and the front end thereof is inserted in the opening 191 formed in the traction means 20 so that the hole 76*b* of the attachment body 76 may coincide with the holes 192, 192 in the traction means 20.

The lever 78 in the lateral groove portion 82*c* is then rotated in the arrow direct, ion F2 as shown in FIG. 21 (*c*) to be positioned in the vertical groove portion 82*a*, and moved in the arrow G2 direction, enabling the slider 77 to move in the hole 76*a* toward the front end of the attachment body 76 to push out the link members 79, 79. The stopper members 80, 80 being coupled with the link members 79, 79 then protrude from the side of the attachment body 76 to be inserted in the holes 192,192 in the traction means 20, coupling the basket 50 with the traction means 20. As a result, the thrust of the traction means 20 will be transmitted to the basket 50 by the aid of the attachment 70 while the basket 50 is supported by the traction means 20.

If the lever 78 is further rotated in the arrow direction F1 as shown in FIG. 21 (c), the slider will be locked and coupled.

Next, the shutting member 56 of the basket 50 is opened and then the front gangway board 60 is brought toward you to get the user of the stairway lift 1 (a wheelchair user) ready for getting in the basket 50. After the user gets in the basket 50, the front gangway board 60 is closed and secured with the clasp 62 before closing the shutting member 60. In this state, the front and rear gangway boards 60, 61, and the shutting members 55, 56 are all closed. By handling the operation box connected to the basket 50 and starting the electric motor in the traction means, the basket ascends the stairway as described in the foregoing embodiment. With basket arriving at the upstairs 3, the clasp 62 is released to open the rear gangway board 61 and the shutting member 55 to allow the user to get off on the upstairs 3.

A description of the effects of the present embodiment will follow.

The present embodiment has almost the same effects as the Foregoing embodiment. That is, the stairway lift 1 according to the present embodiment may be installed more readily than an elevator or an escalator, and no consideration is to be paid to the strength of a side wall when installing. The basket 50 may be removable, which does not interfere with traffic. The traction means 20 and roller guides 9, 10 do not interfere either, while the guide means 6 needs a minimum space for installation. In addition, since the basket 50 is equipped with the attachment 70, it is not necessary to use any tool when coupling the basket 50, or to adjust to the basket 50 in position. The basket 50 may ascend and descend the stairway without any danger, keeping a horizontal posture.

The guide rollers 66, 66 may be coupled with ease since the roller frame 65 is formed to be engageable with the bracket 63 and foldable, which makes it very convenient to transport and store the basket 50. The gangway boards 60, 61 and the frames 52, 53 will help the user get in and out of the basket with much ease, allowing him to enjoy riding because he may know by means of the display panel 57 how the basket is operated.

TECHNICAL ADVANTAGES OF THE INVENTION

As described earlier, the stairway lift based on the present invention may be readily installed by only providing a guide means on the stairway treads and mounting the guide means with a carrier and a mobile body. Accordingly, it does not need any large-scale civil engineering and building work when installing, unlike an elevator or an escalator, but may be installed with minimum incidental work. It does not cost much or take a long time for construction. Since the stairway lift is not a conventional type which is mounted onto the side wall of a stairway, it is not necessary to consider the strength of a side wall when installing. The stairway lift can be installed even onto a stairway without any side wall but only with a handrail. In addition, although the carrier is arranged to project from the guide means to the stairway, it can be detached from the guide means and left detached when not in use. Consequently, the carrier, when detached, does not interfere with passers-by on the stairway. The stairway lift according to the present invention may be installed even if the stairway is wide enough only to let the carrier go up and down, and the stairway may be available as an ordinary stairway for passers-by.

The mobile body does not interfere with the traffic of passers-by on the stairways either, because the mobile body is arranged in a space produced between the sidewall and the guide means, while the carrier does not occupy the space. The space will do if it is wide enough to let the mobile body be arranged therein, and the guide means may be installed in close vicinity to the side wall. As a result, the guide means needs only a minimum space, causing minimum interference with the traffic of passers-by.

Since power to the electric motor is given by moving the power supply point where the power supply cable is in contact with the power supply member, cable intermingling does not happen even when the mobile body travels, unlike when the electric motor is connected directly with the power supply using a cable. When the construction is such that a rotation detection means is provided to tell how fast the mobile body travels, and a brake is put into operation according to the signal from the detection means, the mobile body and the carrier may be stopped with safety even if the carrier travels at a higher speed than specified due to something being wrong with the devices.

When a coupling means to connect the carrier body with the mobile body is provided with a lever member, it will not be necessary to use any tool to attach and detach the carrier body. By interposing a lever member between a first clamp member and a second clamp member, there will be generated a large Force by means of the toggle joint of the lever member as the first and second clamp members relatively move.

Accordingly, even if the carrier is out of position a little when coupling with the mobile body, the toggle joint of the lever member will help the carrier return to the normal position, and it will be not necessary to give fine adjustment to the carrier for position, facilitating the coupling of the carrier with the mobile body. The coupling means may be well engaged by providing a locking member to prevent the first and second clamp members from relatively moving. In addition, if a position detector is provided to detect where the locking member is, the mobile body may be stopped when it detects that the locking member is not, engaged with the clamp members. As a result, there is no possibility that the carrier in operation comes off from the mobile body, loses thrust and falls down.

When the carrier body is so formed as to travel, keeping a horizontal posture by means of a second rail and guide rollers, the carrier body will transport a person or luggage with safety without inclining in the course of operation. It is not necessary to form a guide rail linearly in order for the carrier body to move, keeping a horizontal posture. This is because the stairway lift according to the present invention may be installed even on a stairway with a landing, regardless of the stairway construction. The carrier body does not change in posture even if the mobile body changes in posture when the coupling means is connected allowing for changes of the mobile body in posture as against the carrier.

Since the roller frame is supported movably on the basket body and the roller guides are supported rotatively by the roller frame, the guide rollers may be engageable readily with the guide rail by only moving the roller frame.

This enables the carrier to be attached to and detached from the guide means with ease. When the roller frame is mounted onto the carrier body, projecting toward the upstairs, the carrier body may be engaged with the guide means without projecting the guide frame bottom to the downstairs. This is because the traffic of passers-by is not hindered due to the bottom of the guide means projecting to the passage on the downstairs side.

A lift means provided near the guide means bottom allows the carrier to be lifted and coupled with the guide means, and the bottom will not project to the downstairs.

Making the carrier foldable will minimize the interference with traffic when transporting the carrier from the stairway to the place where it is to be stored. Storing thus requires much less space.

What is claimed is:

1. A stairway lift, comprising:

a stairway having stairs with treads and a sidewall along said stairs;

a guide provided on said treads of said stairs along said sidewall such that a space is formed between said sidewall and said guide, said guide comprising a first side facing said sidewall, a first rail provided on said first side, a chain rack provided on said first side and extending along said sidewall and a second side facing away from said sidewall;

a mobile body supported by said first rail in said space formed between said sidewall and said guide, said mobile body comprising a drive sprocket engageable with said chain rack, and an electric motor coupled with said drive sprocket for rotatively driving said drive sprocket;

a carrier; and a coupling arrangement coupling said mobile body and said carrier such that said carrier is removably supported by said mobile body on said second side of said guide and guided for travel by said guide, whereby said carrier can ascend and descend said stairway together with said mobile body.

2. The stairway lift of claim 1, wherein said guide comprises a power line arranged on said first side and extending along said sidewall and said mobile body has a power supply member connected with said electric motor and contacting said power supply line.

3. The stairway of claim 2, wherein said mobile body further comprises a follower sprocket engageable with said chain rack and rotatable as said mobile body moves along said chain rack, a rotation speed detection means for detecting the rotation speed of said follower sprocket and providing a rotation signal, and a brake for stopping said mobile body along said first rail in response to said rotation signal.

4. A stairway lift, comprising:

a guide disposable on treads of a stairway, said guide comprising a first side, a first rail provided on said first side, a chain rack provided on said first side and a second side opposite to said first side;

a mobile body supported by said first rail, said mobile body comprising a drive sprocket engageable with said chain rack, an electric motor coupled with said drive sprocket for rotatively driving said drive sprocket, a follower sprocket engageable with said chain rack and rotatable as said mobile body moves along said chain rack, a rotation speed detection means for detecting the rotation speed of said follower sprocket and providing a rotation signal, and a brake for stopping said mobile body along said first rail in response to said rotation signal;

a carrier; and a coupling arrangement coupling said mobile body and said carrier such that said carrier is removably supported by said mobile body on said second side of said guide and guided for travel by said guide, whereby said carrier can ascend and descend said stairway together with said mobile body.

5. A stairway lift, comprising:

a guide disposable on treads of a stairway, said guide comprising a first side, a first rail provided on said first side, and a second side opposite to said first side;

an electrically operated mobile body supported by said first rail;

a carrier comprising a carrier body; and a coupling arrangement coupling said mobile body and said carrier such that said carrier is removably supported by said mobile body on said second side of said guide and guided for travel by said guide, said coupling arrangement comprising a first coupling on said carrier body and a second coupling on said mobile body, said first coupling comprising a first clamp member supported by said carrier body, a lever member rotatively supported by said first clamp member, and a second clamp member that is supported by said lever member and movable relative to said first clamp member upon rotation of said lever member, said first clamp member and said second clamp member together being operable to hold said second coupling therebetween upon operation of said lever member.

6. The stairway lift of claim 5, wherein one of said first and second clamp members rotatively supports a locking member thereon, the other of said first and second clamp members is provided with an engagement unit engageable by said locking member, and said first and second clamp members are relatively immovable when said locking member is engaged with said engagement unit.

7. The stairway lift of claim 6, and further comprising a position detecting means for detecting the position of said locking member and stopping said mobile body when said locking member is not engaged with said engagement unit.

8. The stairway lift of claim 6, wherein said carrier comprises a plurality of guide rollers rotatively supported thereon and said guide has a second rail located on said second side, said guide rollers engaging said second rail such that said carrier is guided by said second rail, and said second rail having a shape such that said carrier is maintained in a horizontal position when said guide rollers engage said second guide rail and said first and second couplings are engaged with each other while allowing for changes in the posture of said mobile body relative to said carrier.

9. The stairway lift of claim 8, wherein said second rail comprises a guide rail, said plurality of guide rollers and said guide rail having a sectional shape such that said guide rail maintains engagement with said plurality of guide rollers and laterally supports said plurality of guide rollers.

10. The stairway lift of claim 9, wherein:

said carrier further comprises a roller frame movably supported on said carrier body;

said plurality of guide rollers comprises a first guide roller rotatively supported on said carrier body and a second guide roller rotatively supported on said roller frame; and said roller frame is selectively movable between a first position in which said first and second guide rollers are maintained in engagement with said guide rail such that said carrier is movably supported by said guide and a second position in which said second guide roller is disengaged from said guide rail in order to allow said carrier to be released from said guide.

11. The stairway lift of claim 10, wherein:

said roller frame projects from said carrier body in a direction of upward movement of said carrier on said guide;

said second rail comprises a pair of guide rails disposed opposite to each other including a top guide rail and a bottom guide rail; and said second guide roller is pressed upwardly into engagement with said top guide rail and said first guide roller is pressed downwardly into engagement with said bottom guide rail due to a moment generated by said second guide roller being supported by said roller frame.

12. The stairway lift of claim 10, wherein said carrier further comprises a lock means for locking said roller frame in said first position.

13. The stairway lift of claim 12, wherein:

said roller frame projects from said carrier body in a direction of upward movement of said carrier on said guide;

said second rail comprises a pair of guide rails disposed opposite to each other including a top guide rail and a bottom guide rail; and said second guide roller is pressed upwardly into engagement with said top guide rail and said first guide roller is pressed downwardly into engagement with said bottom guide rail due to a moment generated by said second guide roller being supported by said roller frame.

14. A stairway lift, comprising:

a guide disposable on treads of a stairway, said guide comprising a first side, a first rail provided on said first side, and a second side opposite to said first side;

an electrically driven mobile body supported by said first rail;

a carrier having a plurality of guide rollers rotatively supported thereby; and a coupling arrangement coupling said mobile body and said carrier such that said carrier is removably supported by said mobile body on said second side of said guide and guided for travel by said guide, whereby said carrier can ascend and descend said stairway together with said mobile body;

wherein said guide has a curved second rail on said second side thereof having said plurality of guide rollers of said carrier engageable therewith, said second rail having a shape such that said carrier is maintained in a horizontal posture when said plurality of guide rollers are engaged therewith;

wherein said second rail comprises a guide rail, said plurality of guide rollers and said guide rail having a sectional shape such that said guide rail maintains engagement with said plurality of guide rollers and laterally supports said plurality of guide rollers;

said carrier further comprises a roller frame movably supported on said carrier body;

said plurality of guide rollers comprises a first guide roller rotatively supported on said carrier body and a second guide roller rotatively supported on said roller frame; and said roller frame is selectively movable between a first position in which said first and second guide rollers are maintained in engagement with said guide rail such that said carrier is movably supported by said guide and a second position in which said second guide roller is disengaged from said guide rail in order to allow said carrier to be released from said guide.

15. The stairway lift of claim 14, wherein said carrier further comprises a lock means for locking said roller frame in said first position.

16. The stairway lift of claim 14, wherein:

said roller frame projects from said carrier body in a direction of upward movement of said carrier on said guide;

said second rail comprises a pair of guide rails disposed opposite to each other including a top guide rail and a bottom guide rail; and said second guide roller is pressed upwardly into engagement with said top guide rail and said first guide roller is pressed downwardly into engagement with said bottom guide rail due to a moment generated by said second guide roller being supported by said roller frame.

17. A stairway lift, comprising:

a stairway having stairs with treads and a sidewall along said stairs, said stairs extending between a downstairs floor and an upstairs floor;

a guide provided on said treads of said stairs along said sidewall such that a space is formed between said sidewall and said guide, said guide comprising a downstairs end, an upstairs end, a first side facing said sidewall, a first rail provided on said first side, a rack provided on said first side and extending along said sidewall, a power line arranged on said first side and extending along said sidewall and a second side facing away from said sidewall;

a mobile body supported by said first rail in said space formed between said sidewall and said guide, said mobile body comprising a drive sprocket engageable with said rack, an electric motor coupled with said drive sprocket for rotatively driving said drive sprocket and a power supply member connected with said electric motor and contacting said power supply line;

a carrier;

a coupling arrangement coupling said mobile body and said carrier such that said carrier is removably supported by said mobile body on said second side of said guide and guided for travel by said guide, whereby said carrier can ascend and descend said stairway together with said mobile body; and a lift located in said downstairs floor adjacent to said downstairs end of said guide, said lift comprising a carrier stage that is vertically movably supported for movement between a first position in which said carrier stage is adjacent to said downstairs floor and a second position in which said carrier stage is raised from said downstairs floor and a drive cylinder for vertically moving said carrier stage, whereby said carrier can be vertically moved on said carrier stage for attachment to and detachment from said mobile body.

18. A stairway lift, comprising:

a guide disposable on treads of a stairway, said guide comprising a first side, a first rail provided on said first side, and a second side opposite to said first side;

an electrically driven mobile body supported by said first rail;

a carrier comprising a mobile base having casters thereunder, a first frame erect on said mobile base, an entrance base movably supported relative to said first frame, a second frame movably supported by said entrance base, a pair of shutting members rotatively supported sides of said first frame, and a pair of gangway boards rotatively supported at ends of said entrance base, said mobile base being smaller than said entrance base, said first and second frames and said pair of gangway boards having erected positions at four sides of said entrance base, said pair of shutting members enclosing a space above said entrance base together with said first frame and said second frame when in closed positions for movement of said carrier along said guide, and said pair of shutting members being folded toward said first frame, said pair of gangway boards being folded toward said entrance base, said second frame being folded toward said entrance base, and said second frame and said entrance base being folded toward said first frame together when said carrier is in a non-use position; and a coupling arrangement coupling said mobile body and said carrier such that said carrier is removably supported by said mobile body on said second side of said guide and guided for travel by said guide, whereby said carrier can ascend and descend said stairway together with said mobile body.

19. A stairway lift, comprising:

a guide disposable on treads of a stairway, said guide comprising a first side, a first rail provided on said first side, a chain rack provided on said first side and a second side opposite to said first side;

a mobile body supported by said first rail, said mobile body comprising a drive sprocket engageable with said chain rack, and an electric motor coupled with said drive sprocket for rotatively driving said drive sprocket;

a carrier; and a coupling arrangement coupling said mobile body and said carrier such that said carrier is removably supported by said mobile body on said second side of said guide and guided for travel by said guide, whereby said carrier can ascend and descend said stairway together with said mobile body.

* * * * *